US010308029B2

(12) United States Patent
Kudo et al.

(10) Patent No.: US 10,308,029 B2
(45) Date of Patent: Jun. 4, 2019

(54) LIQUID HOLDING UNIT AND LIQUID EJECTION DEVICE

(71) Applicant: SEIKO EPSON CORPORATION, Tokyo (JP)

(72) Inventors: Shoma Kudo, Nagano (JP); Naomi Kimura, Nagano (JP); Hideki Okumura, Nagano (JP); Motoyoshi Shirotori, Nagano (JP); Kazuo Otsuka, Nagano (JP); Masafumi Furuyama, Bekasi (ID)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/608,105

(22) Filed: May 30, 2017

(65) Prior Publication Data

US 2017/0355197 A1 Dec. 14, 2017

(30) Foreign Application Priority Data

Jun. 10, 2016 (JP) ..... 2016-116155
Nov. 4, 2016 (JP) ..... 2016-216150

(51) Int. Cl.
*B41J 2/175* (2006.01)
*B41J 29/02* (2006.01)

(52) U.S. Cl.
CPC ..... *B41J 2/17509* (2013.01); *B41J 2/1754* (2013.01); *B41J 2/17513* (2013.01); *B41J 2/17553* (2013.01); *B41J 2/175* (2013.01); *B41J 29/02* (2013.01)

(58) Field of Classification Search
CPC ... B41J 2/17509; B41J 2/17513; B41J 2/1754
See application file for complete search history.

(56) References Cited

U.S. PATENT DOCUMENTS

| | | | | |
|---|---|---|---|---|
| 6,076,920 | A | 6/2000 | Zapata et al. | |
| 6,164,768 | A | 12/2000 | Murphy et al. | |
| 7,458,665 | B2 | 12/2008 | Batista et al. | |
| 2004/0061748 | A1 | 4/2004 | Kuwabara et al. | |
| 2008/0297571 | A1 | 12/2008 | Umeda | |
| 2012/0127245 | A1 * | 5/2012 | Liu | B41J 2/17506 347/86 |
| 2014/0104349 | A1 | 4/2014 | Kimura et al. | |
| 2015/0124028 | A1 | 5/2015 | Kimura et al. | |

(Continued)

FOREIGN PATENT DOCUMENTS

| | | | |
|---|---|---|---|
| CN | 101786379 A | | 7/2010 |
| JP | 61244560 A | * | 4/1985 |

(Continued)

*Primary Examiner* — Jason S Uhlenhake

(57) ABSTRACT

A liquid holding unit supplies liquid to a liquid ejector of a liquid ejection device. The liquid holding unit includes a liquid holder, an inlet, a plug, a shaft, and an engagement portion. The liquid holder holds the liquid. The housing accommodates the liquid holder. The inlet is used to fill the liquid holder with the liquid. The plug opens and closes the inlet and includes an elastically deformable plug body that covers the inlet and a holding member that holds the plug body and has higher rigidity than the plug body. The shaft is arranged on one of the housing and the plug. The plug is pivotal about the shaft. The engagement portion arranged on the other one of the housing and the plug and engaged with the shaft.

16 Claims, 16 Drawing Sheets

(56) References Cited

U.S. PATENT DOCUMENTS

| | | | | |
|---|---|---|---|---|
| 2015/0283816 | A1 | 10/2015 | Kimura et al. | |
| 2015/0360476 | A1 | 12/2015 | Osakabe et al. | |
| 2016/0089893 | A1* | 3/2016 | Osakabe ..... | B41J 2/17513 347/85 |
| 2016/0200110 | A1 | 7/2016 | Matsushita et al. | |
| 2016/0200111 | A1 | 7/2016 | Kimura et al. | |
| 2017/0313089 | A1 | 11/2017 | Matsushita et al. | |

FOREIGN PATENT DOCUMENTS

| | | | |
|---|---|---|---|
| JP | 3021835 | U | 3/1996 |
| JP | 2001-146021 | A | 5/2001 |
| JP | 2004-142442 | A | 5/2004 |
| JP | 2006-263960 | A | 10/2006 |
| JP | 2008-296508 | A | 12/2008 |
| JP | 2014-079909 | A | 5/2014 |
| JP | 2016-000504 | A | 1/2016 |
| JP | 2016-068473 | A | 5/2016 |
| JP | 2016-087850 | A | 5/2016 |
| JP | 2016-102824 | A | 6/2016 |
| WO | 2015/079547 | A1 | 6/2015 |

* cited by examiner

LIQUID HOLDING UNIT AND LIQUID EJECTION DEVICE

CROSS-REFERENCE TO RELATED APPLICATIONS

This application is based upon and claims the benefit of priority from prior Japanese Patent Application No. 2016-116155, filed on Jun. 10, 2016, and Japanese Patent Application No. 2016-216150, filed on Nov. 4, 2016, the entire contents of which are incorporated herein by reference.

BACKGROUND

The present invention relates to a liquid holding unit, which holds liquid supplied to a liquid ejector of a liquid ejection device, and a liquid ejection device.

JP-A-2016-000504 discloses an example of a liquid ejection device (liquid consumption device) including a liquid ejector that ejects liquid onto a target such as paper. The liquid ejection device is provided with a liquid holding unit that includes a tank (one example of liquid holder), a cap (one example of plug), and a cover. The tank holds ink (one example of liquid) that is supplied to the liquid ejector. The cap opens and closes an inlet of the tank. The cover opens and closes an opening of a compartment that accommodates the tank. An inner side of the cover includes a holding portion to hold the cap, which has been removed by the user, when the cover is located at an open position. When the cap is held by the holding portion, the cap is located in a movement region (movement path) of the cover that extends from the open position to a close position. This restricts movement of the cover to the close position and avoids a situation in which the user forgets to plug the inlet with the cap, which has been removed from the inlet by the user.

In the liquid ejection device of Japanese Laid-Open Patent Publication No. 2016-000504, the user holds the cap between fingers to remove the cap from the inlet. As a result, ink may be applied from the cap to the fingers and smear the hand of the user. A liquid holding unit that supplies the liquid ejector with liquid other than ink also has the same shortcoming.

SUMMARY

It is an object of the present invention to provide a liquid holding unit and a liquid ejection device that reduces the frequency in which liquid is applied from the plug to the fingers when the user opens and closes the inlet with the plug.

In one aspect of the present disclosure, a liquid holding unit supplies liquid to a liquid ejector of a liquid ejection device. The liquid holding unit includes a liquid holder, a housing, an inlet, a shaft, and an engagement portion. The liquid holder is capable of holding the liquid. The housing accommodates the liquid holder. The inlet is used to fill the liquid holder with the liquid. The plug is configured to open and close the inlet. The plug includes an elastically deformable plug body that covers the inlet and a holding member that holds the plug body and has higher rigidity than the plug body. The shaft is arranged on one of the housing and the plug. The plug is pivotal about the shaft. The engagement portion is arranged on the other one of the housing and the plug. The engagement portion is engaged with the shaft.

With this structure, when the user opens and closes the plug to fill the liquid holder with liquid, the frequency in which liquid is applied from plug body to the fingers or the like of the user is reduced. Further, the plug is pivoted about the shaft to open and close the inlet. Thus, when holding an end part, which is located at the end of the holding member at the opposite side of the shaft, the law of the lever reduces the force required to open or close the plug.

Preferably, the holding member includes a first end, a second end, and a side end that intersects the first end and the second end. The holding member further includes a tab arranged on the first end. The tab is held to open and close the inlet.

With this structure, the user may hold the tab to open or close the plug. This facilitates opening and closing of the plug and further reduces the frequency in which liquid is applied from plug body to the fingers or the like of the user.

Preferably, the plug body is located between the tab and the second end on the holding member.

This structure further easily avoids a situation in which the user inadvertently touches the portion of the plug body located at the side where the inlet is located when opening or closing the plug resulting in the application of liquid from the plug body to the fingers or the like of the user.

Preferably, the liquid holder is one of a plurality of liquid holders, the plug is one of a plurality of plugs, and each of the plugs is arranged on a corresponding one of the liquid holders and includes the plug body for the corresponding one of the liquid holders.

In this structure, each liquid holder is provided with a plug. Thus, compared to a structure in which multiple plug bodies are formed integrally with one another, this reduces the frequency in which liquid is applied from the plug body to the fingers or the like of the user when opening and closing the plug body.

Preferably, the holding member is elongated in one direction and configured to hold the plug body so that the plug body is movable in a longitudinal direction of the holding member.

With this structure, the plug body of the plug has a certain degree of freedom in the longitudinal direction of the holding member. Thus, when the plug body is fitted to or comes into contact with inlet, the plug body is moved relative to the holding member and positioned relative to the inlet. This ensures that the inlet is sealed and reduces the frequency in which defective sealing of the inlet occurs. For example, the entrance of foreign matter into the liquid holder and the evaporation or volatilization of liquid out of the liquid holder that would result from defective sealing of the inlet is reduced.

Preferably, the liquid holding unit further includes a positioning guide including a projection and a recess. The positioning guide is configured to guide and position the plug relative to the inlet by inserting the projection into the recess in a state in which the inlet is closed by the plug. The holding member includes one of the projection and the recess. The liquid holder or the housing includes the other one of the projection and the recess.

With this structure, when moving the plug from the open position to the close position, the projection is inserted into the recess. This positions the plug at the proper position and ensures that the plug body seals the inlet. Thus, the entrance of foreign matter into the liquid holder and the evaporation or volatilization of liquid out of the liquid holder that would result from defective sealing of the inlet is reduced.

Preferably, the liquid holding unit further includes a cover that covers the plug. The cover or the housing includes a restriction portion that contacts the holding member in a state in which the holding member is pivoted in a direction opening the inlet to restrict a pivot range of the holding member.

With this structure, the pivot range of the holding member is restricted when opening the plug. This limits the liquid that is applied from the plug body to the fingers or the like of the user when opening and closing the plug as compared with when, for example, the holding member has no restricted pivot range and is pivoted by approximately 180 degrees to an open position where the holding member lies horizontally. Thus, the liquid applied from the plug body to the fingers or the like of the user is further reduced.

Preferably, the liquid holding unit further includes a cover that covers the plug. The cover includes a pushing portion that is capable of pushing the plug toward the inlet.

With this structure, the pushing portion pushes the plug toward the inlet when closing the cover. This restricts separation of plug from the inlet and prevents evaporation and volatilization of liquid.

The holding member includes a through hole into which at least part of the plug body is fitted. Preferably, a covering covers an opening of the through hole at an opposite side of the plug body. The covering is in correspondence with a color of the liquid held in the liquid holder.

With this structure, the covering functions to conceal the through hole of the holding member and to indicate a color. This improves the aesthetic appeal of the plug and allows the user to check the color by looking at the covering when opening the plug. Thus, situations are reduced in which the liquid holder is filled with liquid of the wrong color.

Preferably, the holding member includes a first piece located toward a first end of the holding member and provided with the plug body, a second piece located toward a second end of the holding member, and a pivot located between the first piece and the second piece. In a state in which the plug is located at an open position, the holding member takes a bent formation in which the first piece is pivoted about the pivot relative to the second piece in a direction in which the plug body approaches the inlet. In a state in which the plug is located at a close position, the holding member takes a straight formation in which the first piece and the second piece are arranged straight.

With this structure, the holding member takes the straight formation when the plug closes the inlet at the close position. Thus, the plug body seals the inlet. Further, the holding member takes the bent formation so that the plug body is directed toward the inlet when the plug opens the inlet and is located at the open position. This limits the liquid that is applied from the plug body to the fingers or the like of the user. Thus, the frequency in which liquid is applied from the plug body to the fingers or the like of the user is further reduced.

Preferably, the holding member further includes an urging member that urges the holding member in a direction that bends the holding member from the straight formation to the bent formation.

With this structure, the holding member is urged in the direction in which the holding member takes the bent formation. Thus, when opening the plug, the holding member takes the bent formation without the need for the user to adjust the force applied to bend the holding member. This further reduces the frequency in which liquid is applied from the plug body to the fingers or the like of the user when opening and closing the plug.

Preferably, the liquid holding unit further includes a cover, which is configured to open and close so that the cover exposes the plug in an open state and covers the plug in a closed state, and a formation holding mechanism, which that contacts at least one of the first piece and the second piece when the cover is in the closed state to hold the holding member in the straight formation and keep the plug body at the close position.

With this structure, when closing the cover after closing the plug, the formation holding mechanism contacts at least one of the first piece and the second piece to hold the holding member in the straight formation. Thus, even though the holding member is urged in a direction in which the holding member takes the bent formation, the plug may be kept at the close position when the cover is closed. This reduces the occurrence of defective sealing that would be caused by the urging force of the urging member that moves the plug body away from the inlet. Thus, for example, the entrance of foreign matter into the liquid holder and the evaporation or volatilization of liquid out of the liquid holder that would result from defective sealing of the inlet foreign matter are limited.

In a further aspect of the present disclosure, a liquid holding unit supplies liquid to a liquid ejector of a liquid ejection device. The liquid holding unit includes a liquid holder, a housing, an inlet, a plug, and a guide. The liquid holder is capable of holding the liquid. The housing accommodates the liquid holder. The inlet is used to fill the liquid holder with the liquid. The plug is configured to open and close the inlet. The plug includes an elastically deformable plug body that covers the inlet and a holding member that holds the plug body and has higher rigidity than the plug body. The guide is included in the liquid holder or the housing. The guide is configured to hold the holding member of plug so that the holding member is slidable.

With this structure, the plug slides to open and close the inlet. Thus, the plug body does not have to be pulled when removed from the inlet. This reduces the force needed to open or close the plug.

Preferably, the holding member is elongated in one direction and configured to hold the plug body so that the plug body is movable in a longitudinal direction of the holding member.

With this structure, the plug has a certain degree of freedom in the position of the plug body relative to the holding member in the longitudinal direction of the holding member. This ensures that the inlet is sealed. Thus, for example, the entrance of foreign matter into the liquid holder and the evaporation or volatilization of liquid out of the liquid holder that would result from defective sealing of the inlet foreign matter are limited.

Preferably, the liquid holder or the housing includes a restriction portion that contacts the holding member to restrict a slide range of the holding member.

With this structure, a situation may be avoided in which the plug falls out of the liquid holder or the housing when moving the plug along the guide. This avoids a situation in which liquid is applied to the location where the plug falls.

Preferably, the holding member includes a through hole into which at least part of the plug body is fitted. The liquid holding unit further includes a covering that covers an opening of the through hole at an opposite side of the plug body. The covering is in correspondence with a color of the liquid held in the liquid holder.

With this structure, the covering functions to conceal the through hole of the holding member and to indicate a color. This improves the aesthetic appeal of the plug and allows the user to check the color by looking at the covering. Thus, situations are reduced in which the liquid holder is filled with liquid of the wrong color.

Another aspect of the present disclosure is a liquid injection device including the liquid holding unit and a liquid ejector that ejects liquid supplied from the liquid holder of the liquid holding unit.

With this structure, the liquid injection device includes the liquid holding unit. Thus, the advantages of the liquid holding unit are obtained.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

First Embodiment

An all-in-one machine including a liquid ejection device (e.g., printer) will now be described with reference to the drawings. The liquid ejection device of the present embodiment is configured by an inkjet printer that performs printing by ejecting liquid, such as ink, onto a medium, such as paper. A serial printer that performs printing by moving a liquid ejector in a scanning direction X (hereinafter referred to as the widthwise direction X), which intersects a transfer direction Y of the medium, will be described as an example of a liquid ejection device.

Figure 1:
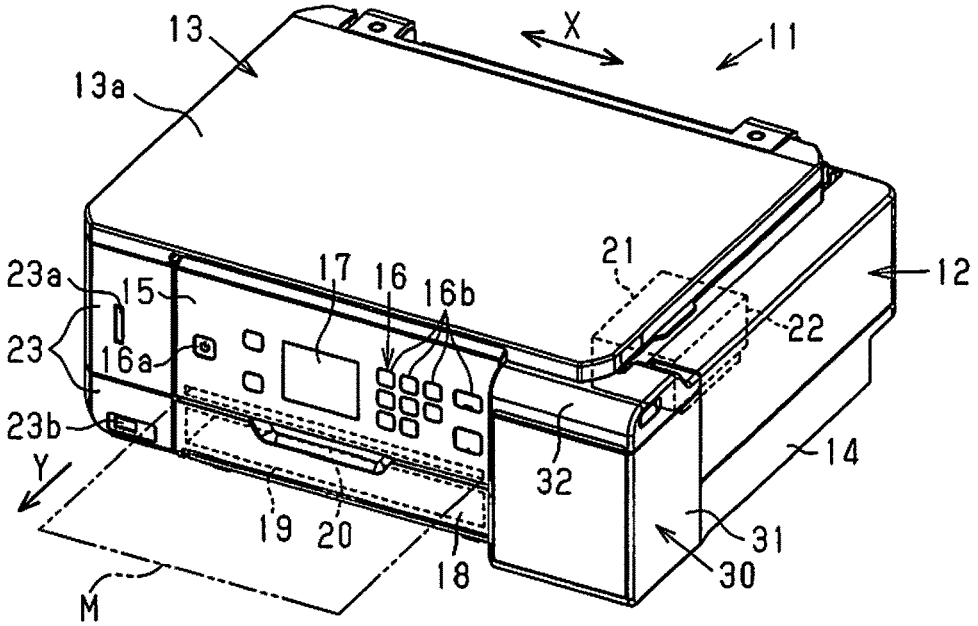
FIG. 1 is a perspective view showing an all-in-one machine including a liquid ejection device of a first embodiment.

As shown in FIG. 1, an all-in-one machine 11 includes a liquid ejection device 12 that ejects liquid and an image reading device 13 that has a reading function. The liquid ejection device 12 includes a box-shaped enclosure 14. The image reading device 13 is located at the upper side of the enclosure 14.

An operation panel 15 is arranged on the enclosure 14. The operation panel 15 includes an operation unit 16 and a display unit 17. The operation unit 16 includes, for example, a power button 16*a* and an operation button 16*b*. The display unit 17 is formed by a touch panel type liquid crystal display screen or the like.

A front cover 18 is pivotal about the front lower end of the enclosure 14 to open and close the front surface of the enclosure 14. A medium cassette 19 and a discharge port 20 are arranged at a rear side of the front cover 18. The discharge port 20 discharges medium M that has undergone printing. The medium M fed from the medium cassette 19 is reversed at an inner position and then transferred in the transfer direction Y along a predetermined transfer path.

As shown in FIG. 1, the enclosure 14 includes a liquid ejector 21 that ejects liquid onto the medium M, which is transferred in the transfer direction Y. To perform, for example, printing, the liquid ejector 21 performs a liquid ejection operation by ejecting liquid toward the medium M at an intermediate position in the transfer path of the medium M. The medium M that has undergone printing is discharged from the discharge port 20 as shown by the double-dashed line in FIG. 1. The discharged medium M is placed on a slide-type stacker (discharge tray, not shown). The stacker extends toward the front of the enclosure 14, which corresponds to the downstream side in the transfer direction of where printing starts. In this example in which the liquid ejection device 12 is a serial printer, the liquid ejector 21 includes a carriage 22 that is movable back and forth in the scanning direction X, which intersects the transfer direction Y. The liquid ejector 21 includes a nozzle (not shown) that allows liquid to be ejected to a portion opposing the transfer path of the medium M. In an example in which the liquid ejection device 12 is a line printer, the liquid ejector 21 is elongated and has a length that allows liquid to be ejected over an entire liquid-ejected region in a widthwise direction X that intersects the transfer direction Y.

As shown in FIG. 1, the liquid ejection device 12 includes a liquid holding unit 30 that supplies the liquid ejector 21 with liquid. In the present example, the liquid holding unit 30 is located at one of the two ends of the enclosure 14 in the widthwise direction X. A communication unit 23 including communication connectors 23*a* and 23*b* is located at the other one of the two ends of the enclosure 14 in the widthwise direction X. Thus, the liquid holding unit 30 and the communication unit 23 are located at opposite ends in the widthwise direction X. In the example shown in FIG. 1, a case 31 forming part of the enclosure 14 (outer shell) covers one side of the liquid holding unit 30. A cover 32 covers an upper opening of the case 31. The liquid holding unit 30 will be described in detail later.

Figure 2:
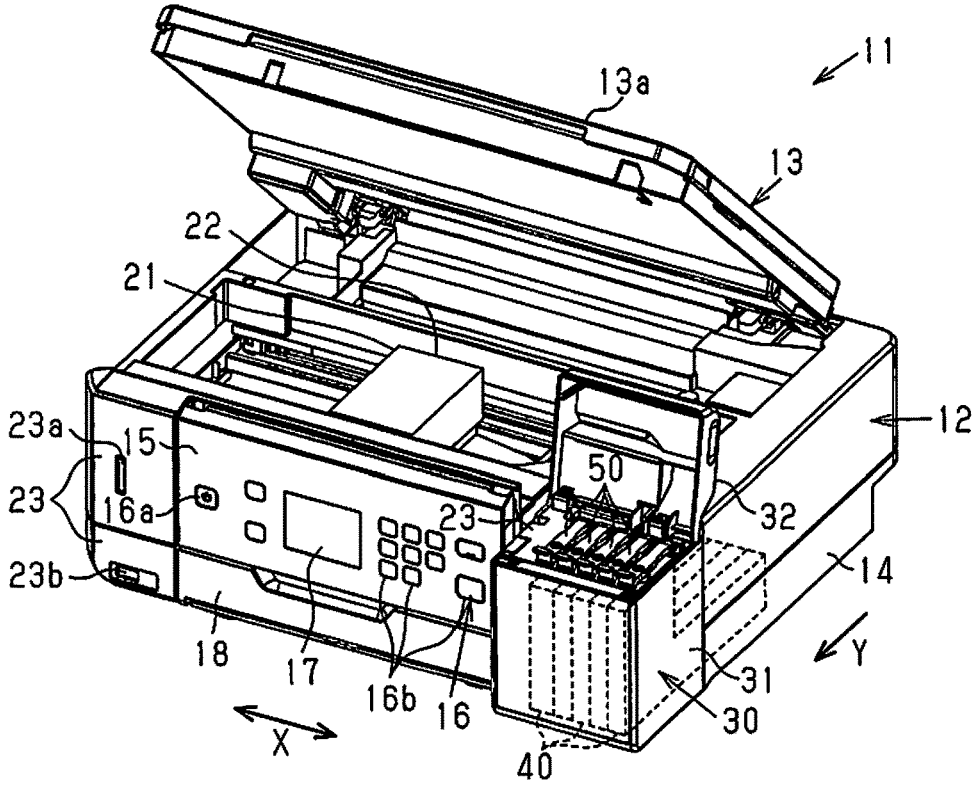
FIG. 2 is a perspective view showing the all-in-one machine of FIG. 1 in a state in which covers of an image reader and a liquid holding unit are open.

The image reading device 13 shown in FIG. 1 includes a document cover 13*a* and an image scanner (not shown). The document cover 13*a* is located at an upper portion of the image reading device 13 and is freely opened and closed. The document cover 13*a* covers a document table of a glass plate (not shown) when the document cover 13*a* is closed. A document (not shown) is placed on the glass plate and covered by the document cover 13*a*. Then, the image scanner reads an image of the document from the lower side. The image reading device 13 is movable relative to the enclosure 14 between a close position shown in FIG. 1 and an open position shown in FIG. 2. For example, to perform maintenance on the liquid ejection device 12 such as when removing jammed media out of the liquid ejection device 12, the image reading device 13 is moved from the close position to the open position to expose the inside of the enclosure 14 to the outside. When refilling the liquid holding unit 30 with liquid, the cover 32 is opened. In the liquid ejection device 12 of the present example, the image reading device 13 is located at the close position that is in the movement path of the cover 32 between the open position and the close position. Thus, the cover 32 is moved from the close position shown in FIG. 1 to the open position shown in FIG. 2 under a situation in which the image reading device 13 is located at the open position. In FIG. 2, to facilitate illustration, the liquid ejector 21, which should be arranged at a standby position as shown in FIG. 1 when the image reading device 13 is located at the open position, is located at a middle position in the movement path of the liquid ejector 21. The cover 32 may be omitted. In such a case, a portion of the image reading device 13 may be used to close the upper opening of the liquid holding unit 30. Alternatively, the upper opening of the liquid holding unit 30 may be kept open.

Referring to FIG. 2, when the cover 32 of the liquid holding unit 30 is moved to the open position, which is located at an open angle in a range from 90 to 170 degrees, from the close position, further movement in the opening direction is restricted. The liquid holding unit 30 includes liquid holders 40 that hold liquid. The liquid holders 40, the number of which is the same as the number of the types of liquids (e.g., color types of ink) that can be ejected from the liquid ejector 21, are arranged in the case 31. The liquid ejector 21 of the present example is capable of ejecting multiple types of liquid. Thus, multiple liquid holders 40 are arranged in the liquid holding unit 30 to supply the multiple types of liquid.

Further, the liquid holding unit 30 includes plugs 50 that open and close inlets 43 (refer to FIG. 5) of the liquid holders 40, respectively. In the present example, a plug 50 is provided for each liquid holder 40 arranged in the housing 33. A user opens the plug 50 corresponding to the liquid holder 40 with which the user wishes to fill liquid with. Then, the user fills the liquid holder 40 with liquid from a liquid bottle (not shown). The liquid holding unit 30 does not have to be formed by part of the enclosure 14 as shown in FIGS. 1 and 2. For example, the liquid holding unit 30 may be attached to the outer wall (e.g., side wall) of the enclosure 14 or be a body that is separated from the enclosure 14 but connected by liquid supply tubes to the enclosure 14. As long as the liquid holding unit 30 is capable of supplying the liquid ejector 21 with liquid through a liquid supply passage, the liquid holding unit 30 may be located inside or outside the enclosure 14.

Figure 3:
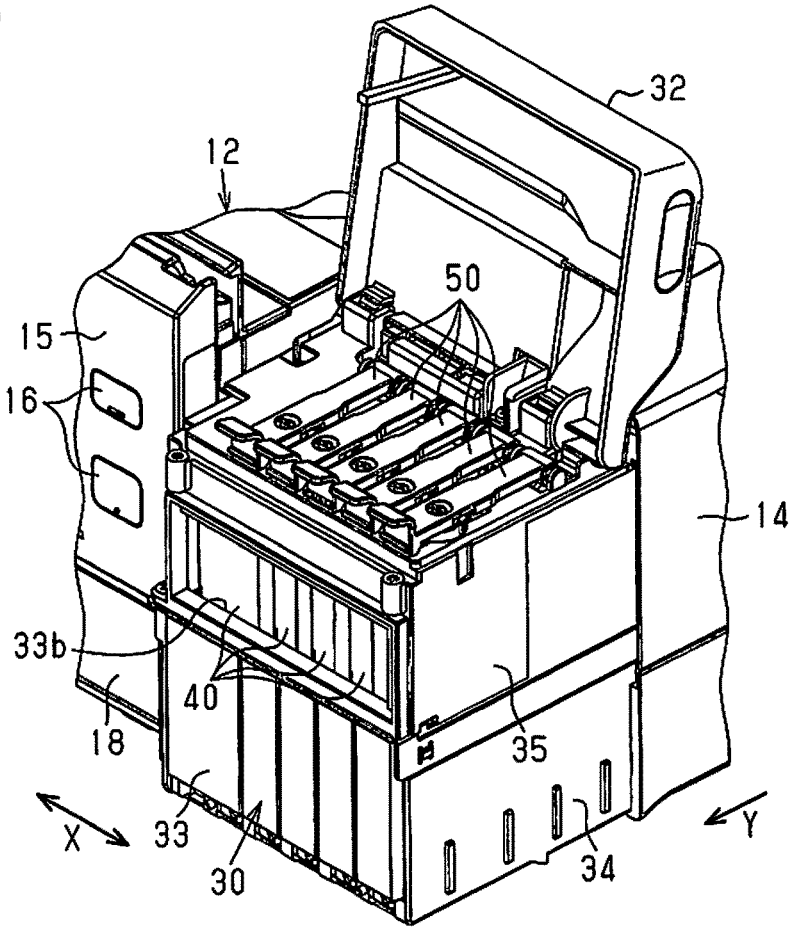
FIG. 3 is a perspective view showing a liquid holding unit of the all-in-one machine of FIG. 1 in a state in which the cover of the liquid holding unit is open.

The liquid holding unit will now be described in detail with reference to FIGS. 3 to 5. FIG. 3 shows a state in which the case 31 is removed from the enclosure 14 and the cover 32 is open. As shown in FIG. 3, the liquid holding unit 30 includes the housing 33 that accommodates the liquid holders 40. The liquid holders 40 are arranged in the housing 33. The plugs 50 are pivotally supported by an upper surface of the housing 33 at positions corresponding to the liquid holders 40. In this manner, each of the plugs 50 are arranged in correspondence with each of the liquid holder 40.

Figure 5:
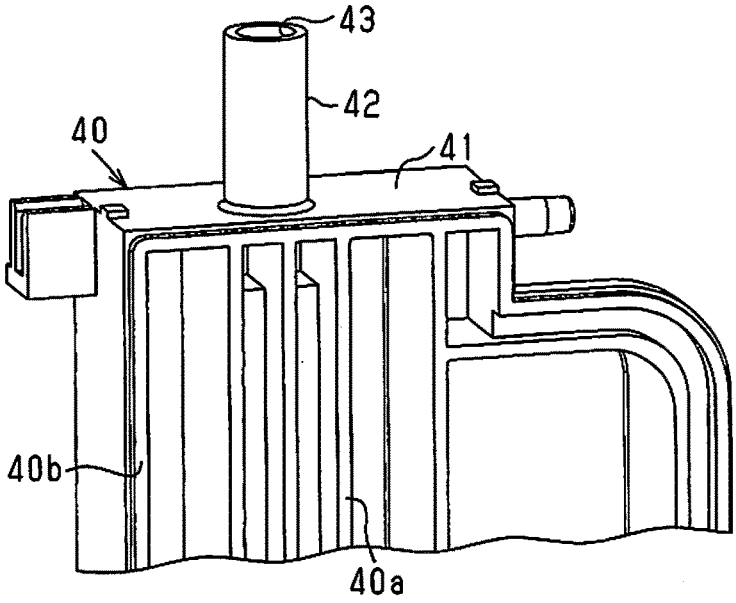
FIG. 5 is a perspective view showing, in part, a liquid holder of the liquid holding unit of FIG. 4.
Figure 6:
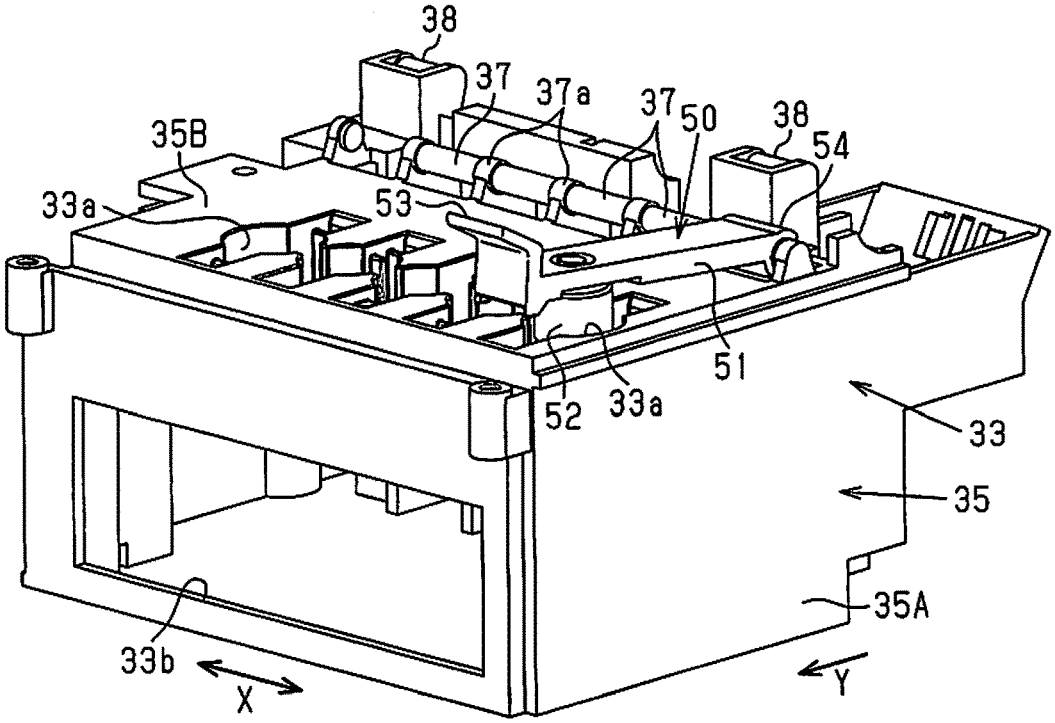
FIG. 6 is a perspective view showing a portion of a housing to which a plug is coupled in the liquid holding unit of FIG. 3.

As shown in FIG. 3, the housing 33 includes a lower housing 34, which is hollow and has a closed bottom, and an upper housing 35, which is hollow. FIG. 4 shows the liquid holding unit 30 without the upper housing 35. FIG. 5 shows the upper portion of the liquid holder 40. FIG. 6 shows the upper housing 35 and the plug 50.

Figure 4:
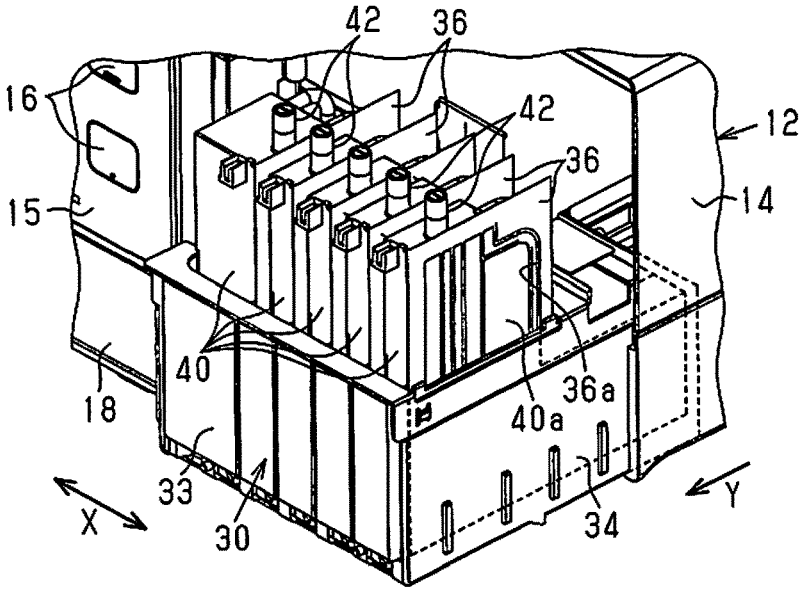
FIG. 4 is a perspective view showing the liquid holding unit of FIG. 3 in a state in which an upper housing is removed.

As shown in FIG. 4, the lower housing 34 includes partition plates 36 that define arrangement regions of the liquid holders 40. The liquid holders 40 are arranged in the corresponding arrangement regions defined by the partition plates 36 in the widthwise direction X. At least a portion of a side wall 40*a* of each liquid holder 40, for example, an edge 40*b* shown in FIG. 5, is fitted to an opening 36*a* in the corresponding partition plate 36 to position the liquid holder 40 in the front-rear direction and the vertical direction of the housing 33.

Referring to FIGS. 3 and 4, the liquid holders 40 of the present example are of different sizes (volumes). When the liquid ejection device 12 is in, for example, a first liquid ejection mode, the liquid ejector 21 ejects liquid (first type of liquid) supplied from a single liquid holder. When the liquid ejection device 12 is in a second liquid ejection mode, the liquid ejector 21 ejects liquid (second type of liquid) supplied from multiple liquid holders 40. Thus, the liquid holder 40 holding the first type of liquid has a relatively large volume, and the liquid holders 40 holding the second type of liquid each have a relatively small volume. In an example in which a liquid ejection operation is a printing operation, the first liquid ejection mode corresponds to a gray scale printing mode, and the second liquid ejection mode corresponds to a color printing mode. For example, the liquid holder 40 that holds black ink is wider than the other liquid holders 40.

In the example shown in FIG. 4, the liquid holder 40 having the maximum volume is arranged at a position located at the end in the arrangement direction (widthwise direction X). A tube 42 of the liquid holder 40 having the maximum volume is located closer to the other liquid holders 40 in the widthwise direction X so that the plugs 50 are arranged at generally equal intervals in the widthwise direction X. The liquid holders 40 may all have the same size (volume) or have different sizes. Further, the combination of liquid holders 40 having different sizes may be changed.

As shown in FIG. 4, each liquid holder 40 includes an upper portion and a lower portion that is, for example, longer toward the rear than the upper portion. Thus, the liquid holding unit 30 avoids the arrangement area of the image reading device 13 or the like, and the liquid holders 40 have relatively large volumes. As shown in FIGS. 4 and 5, each liquid holder 40 includes a holder body 41 and the tube 42, which is used to fill the liquid holder 40 with liquid. The tube 42 projects from one of an upper surface and a side surface (upper surface in example of FIGS. 4 and 5) of the holder body 41 in a direction intersecting that surface. As shown in FIG. 5, each liquid holder 40 includes the inlet 43. Liquid enters the inlet 43 when filling the liquid holder 40 with the liquid. In the example of FIG. 5, the open distal end of the tube 42 defines the inlet 43. Further, each liquid holder 40 includes a front surface that at least partially includes a transparent portion (not shown). The height of the liquid surface in the liquid holder 40 is visible from the outside through the transparent portion. The liquid holder 40 does not have to be shaped so that the lower portion of the holder body 41 is longer than the upper portion of the holder body 41 and may be shaped so that a portion in the widthwise direction has a height that differs from other portions. Further, the liquid holder 40 may have the form of a box, a quadrangular post, a triangular post, or an elliptical post.

As shown in FIG. 6, the upper housing 35 includes a hollow housing 35A that is rectangular and a lid 35B that has the form of a plate and at least partially covers the upper opening of the hollow housing 35A. The plugs 50 are coupled to the upper surface of the lid 35B on the housing 33 (specifically, the upper housing 35). In detail, the upper surface of the housing 33 includes a rear end where shafts 37 are arranged. The two axial ends of each shaft 37 are held by supports 37*a* having a larger diameter than the shaft 37. Thus, each shaft 37 is held between the supports 37*a* extending in the widthwise direction X of the liquid holders 40. As shown in FIG. 6, each plug 50 includes a holding member 51 and a plug body 52 for the corresponding liquid holder 40. The upper surface of the housing 33 shown in FIG. 6 includes a recess 33*a* that is wide enough to allow the insertion of the plug body 52. In a state in which the upper housing 35 is coupled to the lower housing 34 in which the liquid holders 40 are arranged, the tube 42 of each liquid holder 40 projects upward through a round hole (not shown) extending through the bottom portion of the corresponding the recess 33*a*.

Further, as shown in FIG. 6, the front surface of the housing 33 includes a window 33*b* that has a predetermined height and a width corresponding to width of the liquid holders 40. The case 31 includes a transparent window (not shown) at a portion opposing the window 33*b*. Thus, the user can check the liquid surface height (liquid level) of each liquid holder 40 by looking through the transparent window of the case 31 and the window 33*b*. Further, as shown in FIG. 6, two hinges 38 project from the rear end of the housing 33. The cover 32 is coupled to the hinges 38.

Figure 7:
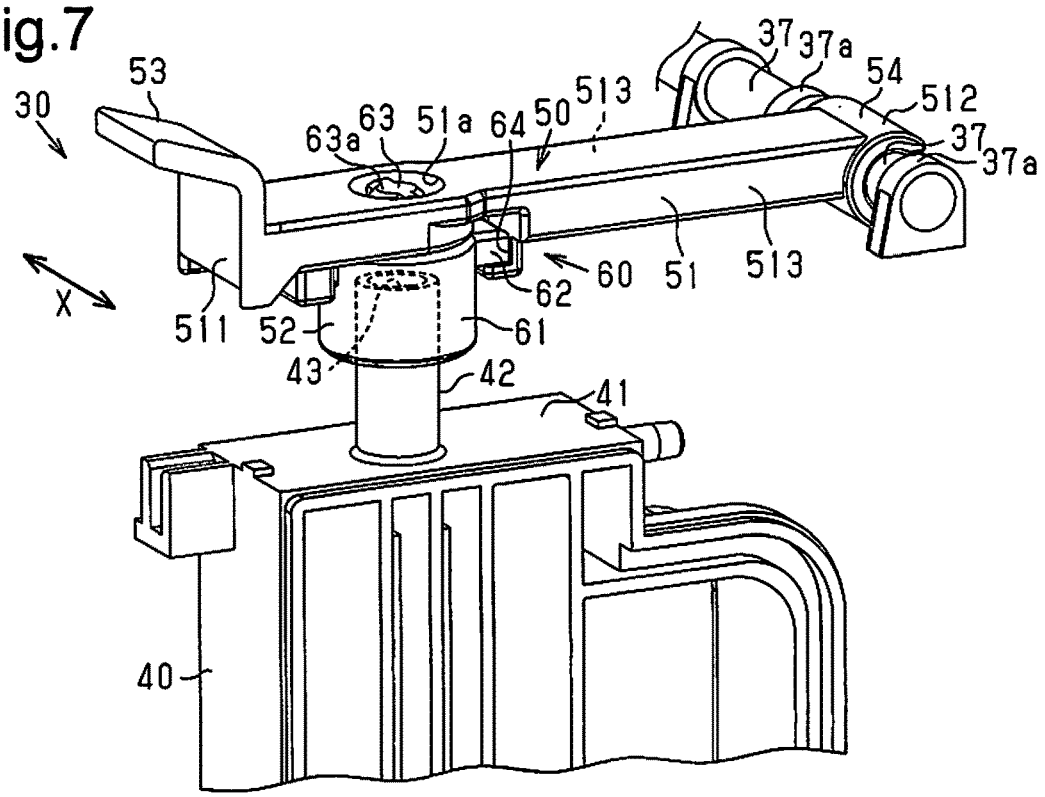
FIG. 7 is a perspective view showing, in part, the liquid holder and the plug in the liquid holding unit of FIG. 3.

As shown in FIGS. 6 and 7, the plug 50 includes the elastically deformable plug body 52, which covers the corresponding inlet 43 (refer to FIG. 5), and the holding member 51, which holds the plug body 52. The holding member 51 is elongated in one direction. As shown in FIG. 7, the holding member 51 includes a first end 511 (one end), a second end 512 (other end), and side ends 513, which intersects the first end 511 (one end) and the second end 512 (other end). More specifically, the side ends 513 intersect the first end 511 and the second end 512 and extend between the first end 511 and the second end 512. In the example of FIGS. 6 and 7, the holding member 51 has the form of a rectangular plate elongated in one direction. Further, the holding member 51 includes the first end 511 defined by a distal end that extends in a short-side direction and the second end 512 defined by a basal end that extends in the short-side direction. The holding member 51 further includes the two side ends 513 defined by the end surfaces extending in the longitudinal direction of the holding member 51 and intersecting both of the end surface (distal end surface) of the first end 511 and the end surface (basal end surface) of the second end 512.

As shown in FIG. 7, the first end 511 of the holding member 51 includes a tab 53 held by the user. The tab 53 projects from the surface of the holding member 51 in a direction (forward direction) extending from the second end 512 toward the first end 511 and in a direction (upward direction as viewed in FIG. 7) extending from the surface (lower surface) of the holding member 51 located at the side of the plug body 52 toward the surface (upper surface) located at the opposite side. FIG. 7 shows an example of the tab 53 that is L-shaped in a cross-sectional side view. The second end 512 of the holding member 51 includes an engagement portion 54 that is engageable with the corresponding shaft 37. The engagement portion 54 has a widthwise length that is slightly shorter than the axial length of each shaft 37. The engagement portion 54 has a C-shaped cross section obtained by cutting part of a ring. The opening of the engagement portion 54 is pressed against the corresponding shaft 37 so that the shaft 37 engages the engagement portion 54.

As shown in FIG. 7, in a state in which the engagement portion 54 is engaged with the shaft 37, the two axial sides of the engagement portion 54 are held between the two corresponding supports 37*a*. This restricts displacement of the plug 50 in the widthwise direction X. Thus, movement of the plug 50 from the open position to the close position positions the plug body 52 relative to the tube 42 in the widthwise direction X. In FIG. 7, to facilitate illustration, a gap extends between each support 37*a* and the engagement portion 54. However, the actual gap is extremely small or an axial displacement restriction spacer (not shown) extends from at least one of the support 37*a* and the engagement portion 54 to restrict displacement of the plug 50 in the widthwise direction X. This structure is also applied to the other embodiments.

As shown in FIG. 7, the plug body 52 is located between the tab 53 at the first end of the holding member 51 and the engagement portion 54 at the second end of the holding member 51. The user holds the tab 53, which is located closer to the first end of the holding member 51 than the plug body 52, between fingers to open or close the plug 50. Thus, liquid of the plug body 52 is not applied to the fingers. The plug 50 is arranged so that the longitudinal direction of the holding member 51 coincides with the longitudinal direction (front-rear direction) of the surface of the corresponding liquid holder 40 including the inlet 43 (tube 42).

The holding member 51 shown in FIGS. 6 and 7 has higher rigidity than the plug body 52. The holding member 51 is formed by a non-flexible member, and the plug body 52 is formed by a flexible member. The material of the non-flexible member may be plastic, metal, or the like. The material of the flexible member may be rubber, elastomer, or the like. The shafts 37, the housing 33, and the liquid holders 40 are formed by non-flexible members. Preferably, the material of the liquid holders 40 is selected from materials that are compatible with the properties of the held liquid (e.g., ink) and realize the functions required for the liquid holders 40. The holding member 51, the shafts 37, and the housing 33 may be formed from the same material or from different materials.

Figure 8:
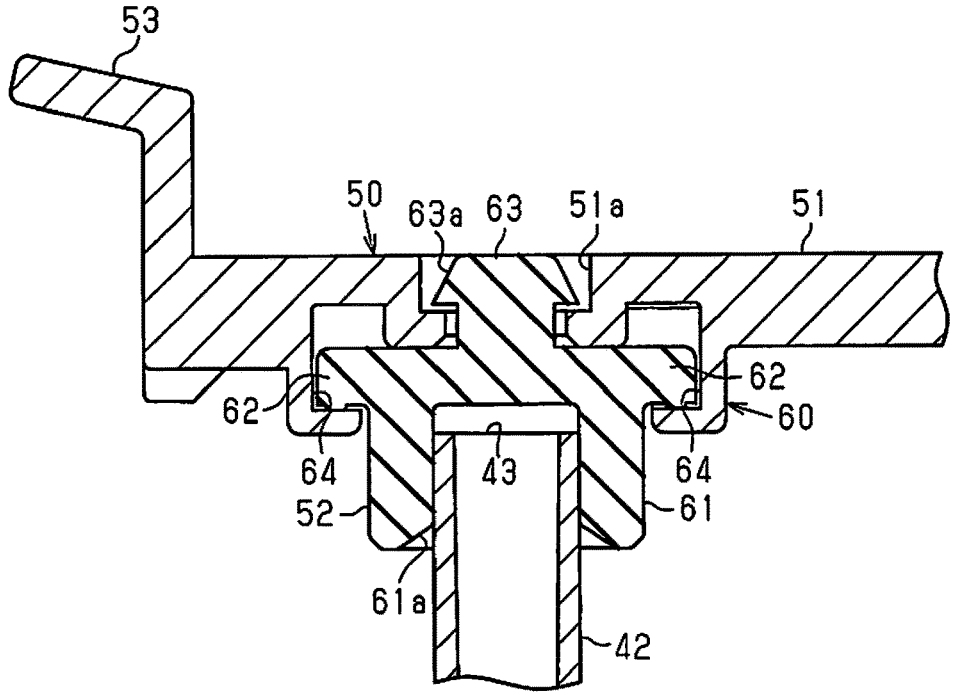
FIG. 8 is cross-sectional side view showing, in part, the plug when sealing an inlet in the liquid holding unit of FIG. 3.
Figure 9:
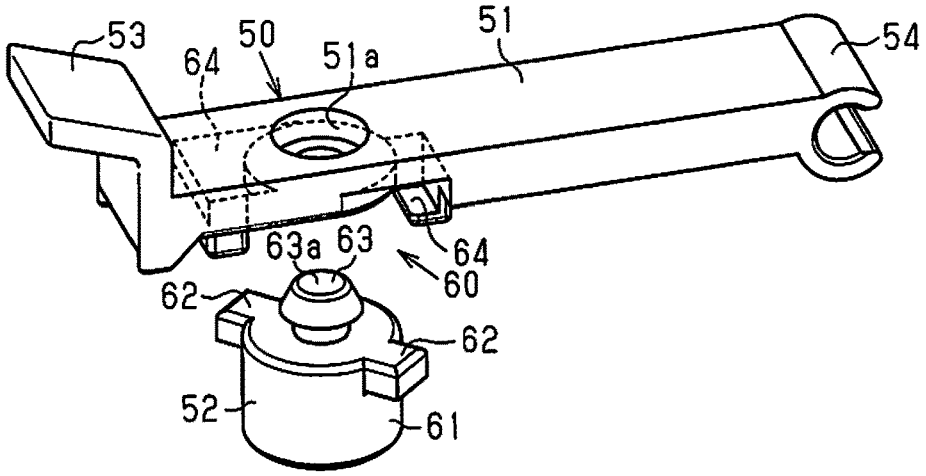
FIG. 9 is a perspective view illustrating a structure coupling a holding member and a plug body in the plug of the liquid holding unit shown in FIG. 3.

Various coupling structures may be used to couple the plug body 52 to the holding member 51 shown in FIG. 7. The present example employs the coupling mechanism 60 to facilitate the coupling of the plug body 52 to the holding member 51. As shown in FIGS. 7, 8, and 9, the holding member 51 includes a through hole 51*a* at a location where the plug body 52 is coupled. In the present example, the plug body 52 is at least partially fitted into the through hole 51*a*. The plug body 52 includes a plug portion 61, two projections 62 (keys), a fitted portion 63, and a stopper 63*a*. The plug portion 61 is tubular and has a closed end. The projections 62 project from opposite sides of the plug portion 61 in the radial direction. The fitted portion 63 project in the axial direction (upward direction as viewed in FIGS. 7 to 9) from the side of the plug portion 61 opposite to the opening. The distal end of the fitted portion 63 includes a stopper 63*a* having the form of a truncated cone.

As shown in FIGS. 7 to 9, the rear surface of the holding member 51 includes two grooves 64 (key grooves) located near the through hole 51*a*. The two projections 62 can be fitted (inserted) into the two grooves 64, respectively. The two grooves 64 each define a groove passage that is arcuate, concentric with the through hole 51*a*, and has one open end and another closed end. The coupling mechanism 60 includes a fastening portion (not shown) that fastens the two projections 62 and the two grooves 64 when the projections 62 are completely fitted into the grooves 64.

Figure 10:
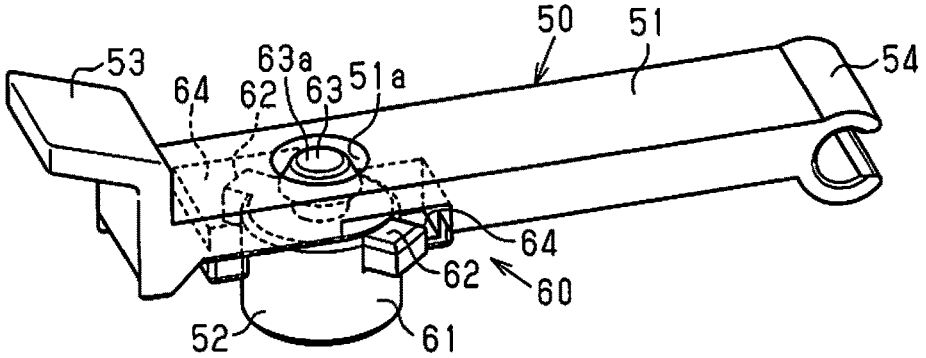
FIG. 10 is a perspective view illustrating the structure coupling the holding member and the plug body in the plug of the liquid holding unit in the same manner as FIG. 9.
Figure 11:
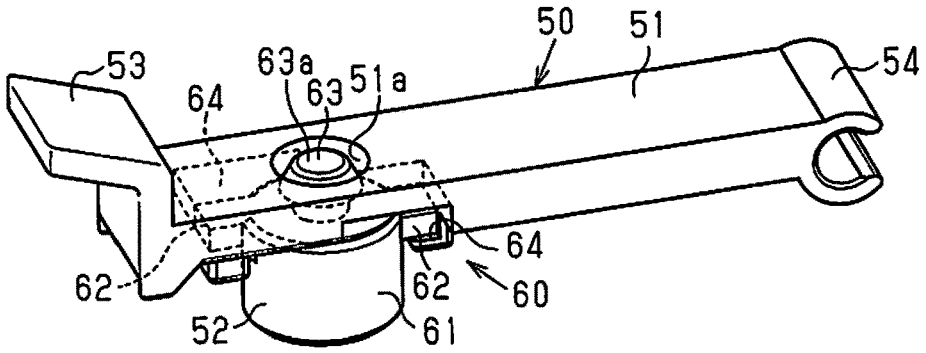
FIG. 11 is a perspective view illustrating the structure coupling the holding member and the plug body in the plug of the liquid holding unit in the same manner as FIGS. 9 and 10.

A method for coupling the plug body 52 to the holding member 51 will now be described with reference to FIGS. 9 to 11. First, referring to FIG. 9, in a state in which the two projections 62 are shifted from the two grooves 64 in a rotation direction, the fitted portion 63 of the plug body 52 is fitted into the through hole 51*a* of the holding member 51. As shown in FIG. 10, the plug body 52 is temporarily coupled to the holding member 51 with the stopper 63*a* fastened to the through hole 51*a* and the basal part of the fitted portion 63 loosely fitted in the through hole 51*a*. Then, the plug body 52 is rotated in the counterclockwise direction to insert the two projections 62 into the two grooves 64. As shown in FIG. 11, when the two projections 62 reach the terminal ends of the two grooves 64, the two projections 62 are engaged with the two grooves 64. In this manner, as shown in FIGS. 8 and 11, the plug body 52 is fixed to the holding member 51 by engagement of a key and key groove.

Referring to FIG. 8, the plug portion 61 is fitted onto the tube 42 to seal the corresponding inlet 43 with the plug body 52 in a liquid-tight state. The distal side of the plug portion 61 includes a guide surface 61*a* defined by an inclined inner circumferential surface that expands as the distal end becomes closer. Thus, even when the axis of the plug body 52 is slightly separated from the axis of the tube 42, the guide surface 61*a*, which comes into contact with the tube 42, is guided along the tube 42 so that the axis of the plug body 52 approaches the axis of the tube 42. This positions the plug portion 61 that is fitted to the tube 42 and seals the inlet 43. The plugging structure in which the plug body 52 plugs the tube 42 is not limited to the above structure.

Figure 12:
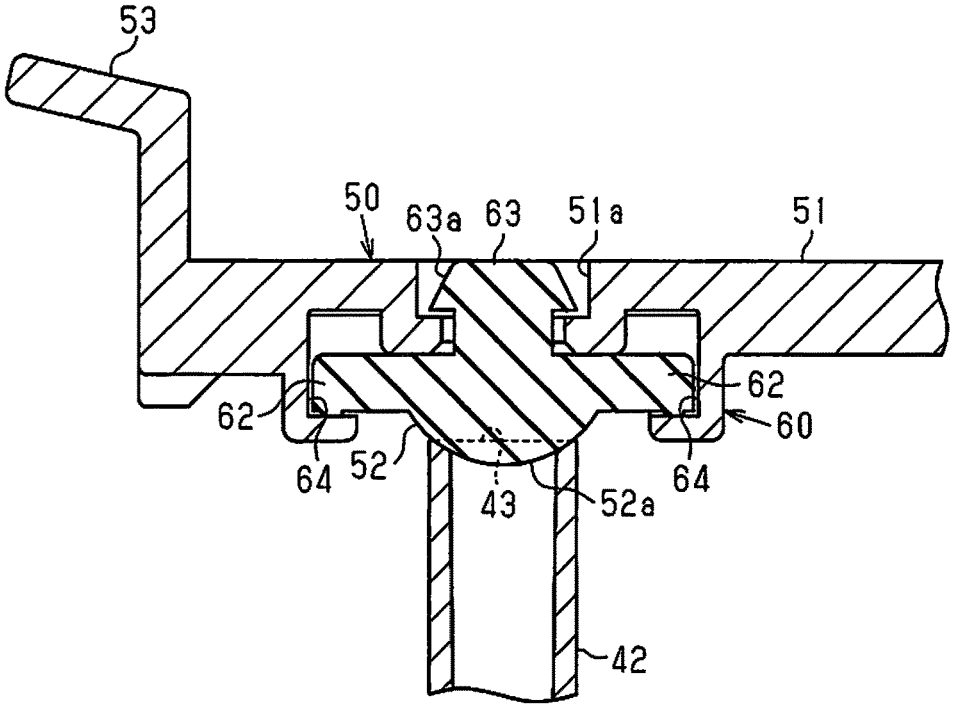
FIG. 12 is a cross-sectional view illustrating another plugging structure of the holding member and the plug body.
Figure 13:
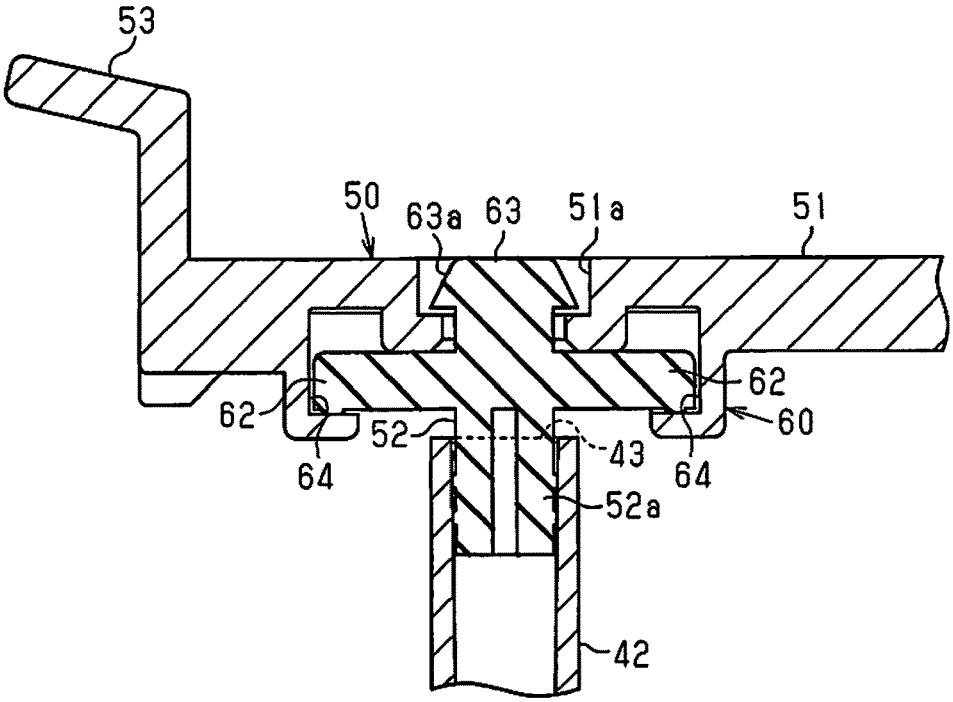
FIG. 13 is a cross-sectional view illustrating a plugging structure, which differs from that of FIG. 12, of the holding member and the plug body.

FIGS. 12 and 13 show examples of other plugging structures. The plug body 52 shown in FIG. 12 is of a type that contacts the tube 42. The plug body 52 is formed by a flexible member. The portion of the plug body 52 that contacts the inlet 43 of the tube 42 defines a plug portion 52*a* that is semispherical and bulged outward. As shown in FIG. 12, the semispherical plug portion 52*a* contacts the open end of the tube 42 and seals the inlet 43 in a liquid-tight manner.

The plug body 52 shown in FIG. 13 is of a type fitted into the tube 42. The plug body 52 is formed by a flexible member and includes a tubular or cylindrical plug portion 52*a*. The plug portion 52*a* is fitted into the tube 42 to seal the inlet 43 in a liquid-tight manner. The plug 50 of each of the examples shown in FIGS. 12 and 13 also couples the plug body 52 to the holding member 51 with the coupling mechanism 60 shown in FIGS. 8 to 11. More specifically, the plug body 52 is fixed to the holding member 51 by the engagement of the two projections 62 (keys) with the two grooves 64 (key grooves). In the coupling mechanism 60 shown in FIGS. 8 to 13, the stopper 63*a* may be omitted from the fitted portion 63.

In the examples shown in FIGS. 8 to 13, part of the plug body 52 (fitted portion 63 and the like) is exposed from the through hole 51*a* in the surface of the holding member 51. Thus, as shown in FIGS. 14 to 17, it is preferred that a structure for concealing exposed structures in the through hole 51*a* be employed.

Figure 14:
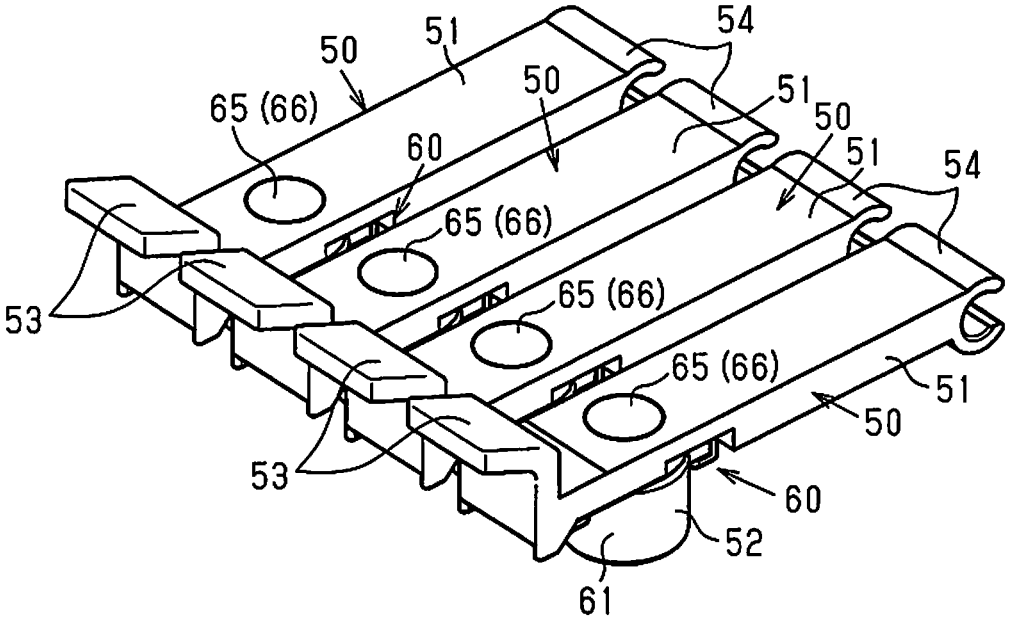
FIG. 14 is a perspective view showing coverings coupled to plugs in the liquid holding unit of FIG. 3.

In the example shown in FIG. 14, the opening (upper opening) of the through hole 51*a* in the holding member 51 at the side opposite to the plug body 52 is covered by a covering 65. The covering 65 is in correspondence with the type of the liquid held in the corresponding liquid holder 40. In the present example, the covering 65 is in correspondence with the color of the liquid. In other words, the covering 65 indicates the type of the liquid held in the liquid holder 40. In the present example, the covering 65 indicates the color of liquid. In this manner, at least a portion of the surface (upper surface) of the covering 65 located at the side opposite to the surface facing the through hole 51*a* indicates the type of the liquid held in the liquid holder 40, which is plugged by the plug 50 including the covering 65. In the present example, the upper surface of the covering 65 indicates the color of the liquid. The color of the liquid may be indicated by entirely or partially coloring the plug 50 in accordance with the color of the liquid. Alternatively, the color of the liquid may be indicated by information related to the color, e.g. color name or color code (serial number). As another option, the color of the liquid may be indicated by both of the color name and the color information.

Figure 15:
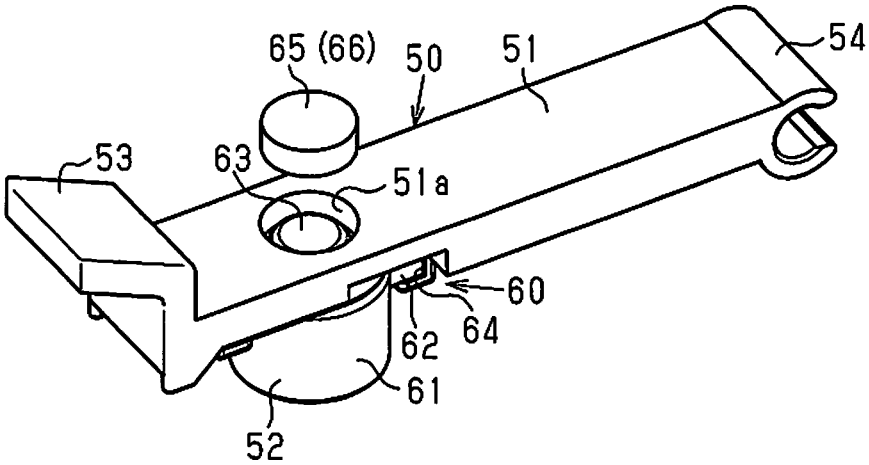
FIG. 15 is an exploded perspective view showing a structure for coupling the covering in the plug of FIG. 14.

In the example shown in FIG. 15, the covering 65 is formed by a cap 66 that has a shape (e.g., shape of disk or tube having closed end) allowing the cap 66 to be fitted into the through hole 51*a* from the upper opening. The cap 66 is, for example, colored with the same color as the liquid held in the corresponding liquid holder 40. The cap 66 is fitted into the through hole 51*a* from the upper opening to cover the upper opening. Thus, even when the plugs 50 are arranged next to one another as shown in FIG. 14, the user can recognize the color of the liquid from at least the coloring of the cap 66 or the color information indicated on the cap 66. This allows the user to check the type (color) of the liquid held in each liquid holder 40 when filling the liquid holder 40 with liquid. This reduces errors in which the liquid holders 40 are filled with liquid of the wrong colors.

Figure 16:
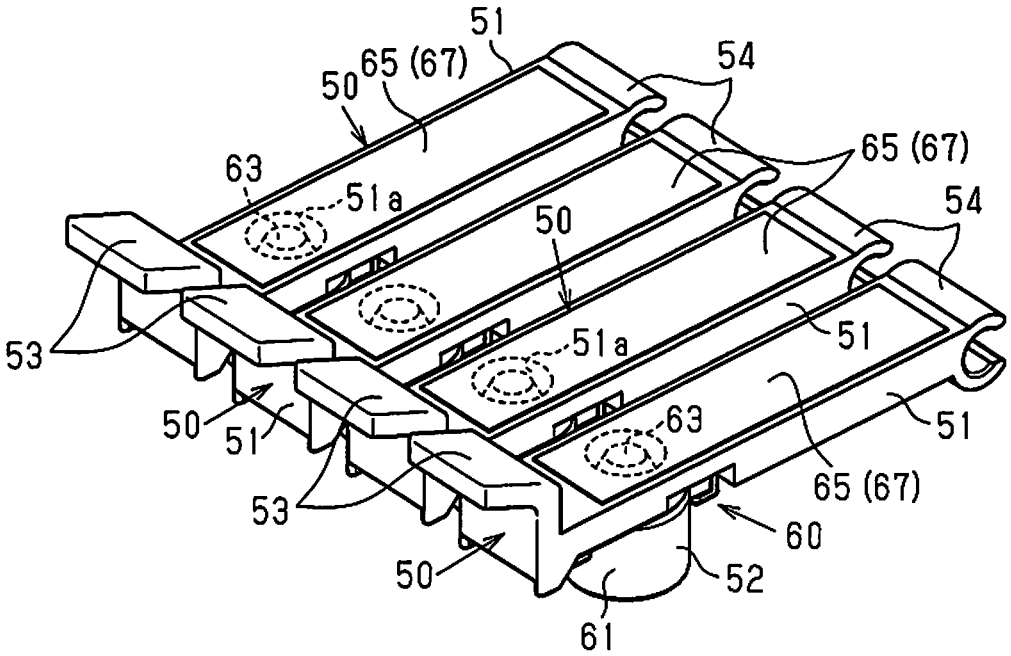
FIG. 16 is a perspective view showing the plugs to which coverings that differ from those of FIG. 14 are coupled.

In the example shown in FIG. 16, the covering 65 is formed by a label 67 that covers the upper opening of the through hole 51*a*. The label 67 indicates the type of the liquid held in the corresponding liquid holder 40 that is plugged by the plug 50 to which the label 67 is applied. In the present example, the label 67 indicates the color of the liquid.

Figure 17:
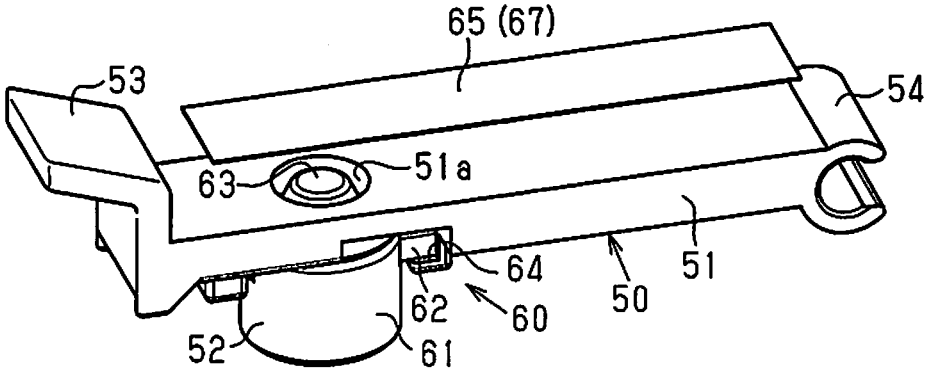
FIG. 17 is an exploded perspective view showing a structure for coupling a covering that differs from that of FIG. 15.

As shown in FIG. 17, the label 67 is applied to the upper surface of the holding member 51 so as to cover the upper opening of the through hole 51*a*. Thus, even when the plugs 50 are arrange next to one another as shown in FIG. 16, the user can recognize the color of the liquid from the color indicated on the label 67 applied to each plug 50, that is, one of the coloring and the color information. This allows the user to check the type (color) of the liquid held in each liquid holder 40 when filling the liquid holder 40 with liquid. This reduces errors in which the liquid holders 40 are filled with liquid of the wrong colors.

Figure 18:
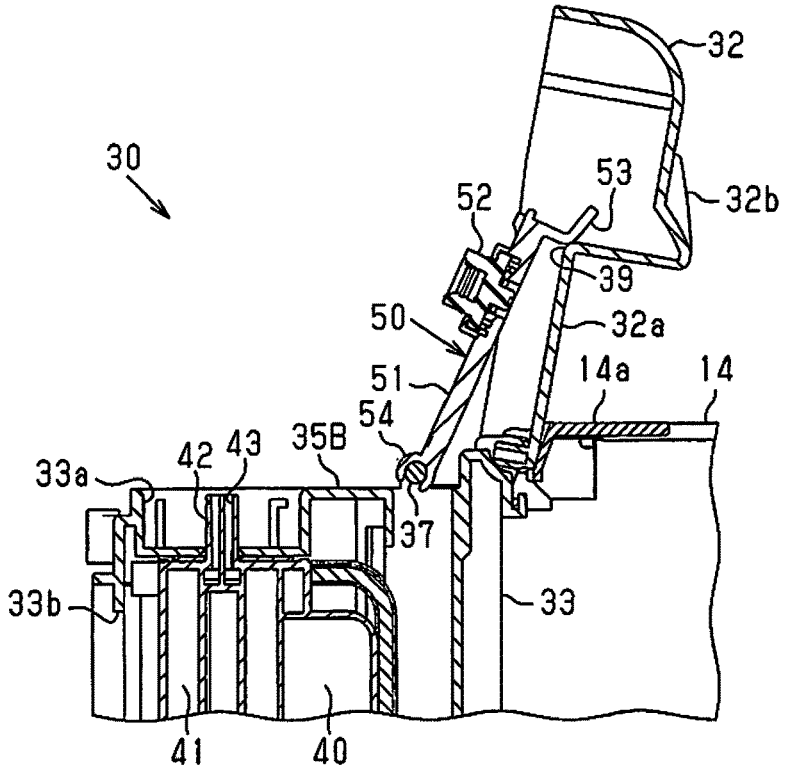
FIG. 18 is a cross-sectional side view showing a structure for restricting the plug of the liquid holding unit of FIG. 3 at an open position.

Preferably, the pivot range of the plug 50 is restricted as shown in FIG. 18. In the example shown in FIG. 18, the plug 50 contacts the cover 32 that is located at the open position. This restricts the pivot range of the plug 50. A restriction portion 39 is arranged in the cover 32. In a state in which the cover 32 is located at the open position, the restriction portion 39 contacts the holding member 51 when the plug 50 is moved to the open position. This restricts the pivot range of the holding member 51. The cover 32 includes a thin portion 32*a* and a thick portion 32*b*. In the radial direction extending outward from the portion of the cover 32 coupled to the hinges 38, the thin portion 32*a* is proximate to the coupled portion and the thick portion 32*b* is distant from the coupled portion. The cover 32 includes a bent portion at the boundary of the thin portion 32*a* and the thick portion 32*b*. The inner side of the bent portion functions as the restriction portion 39. The cover 32 contacts, for example, a restriction portion 14*a* of the enclosure 14 at the open position. This restricts the pivot range of the cover 32 and holds the cover 32 at a predetermined open angle. In a state in which the cover 32 is located at the open position, when opening the plug 50, the corresponding holding member 51 contacts the restriction portion 39. This restricts further movement of the plug 50 in the opening direction and holds the plug 50 at the open position.

The open angle of the plug 50 at the open position from the close position, or reference position (0 degrees) is set to be greater than or equal to the minimum angle at which the plug 50 can remain at the open position without falling to the close position because of its weight and set to be less than or equal to the maximum angle that obtains a sufficient gap (e.g., 5 mm or greater) allowing the user to push the distal end of the tab 53 and close the plug 50 from the open position. Preferably, the open angle of the plug 50 is set to a predetermined angle, for example, in the range from 95 to 170 degrees. In particular, the preferred open angle is 100 degrees or greater since such an angle will ensure that the plug 50 remains at the open position without falling to the close position because of its weight. As the open angle of the plug 50 increases, when closing the plug 50, the fingers used to hold the tab 53 of the plug 50 at the open position comes into contact more easily with the bottom portion of the plug body 52. In this regard, it is preferred that the open angle of the plug 50 be less than or equal to 150 degrees. Thus, it is preferred that the open angle of the plug 50 be set to a predetermined angle that is in the range from 100 to 150 degrees. In the example of FIG. 18, the tab 53 contacts the restriction portion 39. However, other portions of the holding member 51 may contact the restriction portion 39. Further, the location of the restriction portion 39 in the cover 32 relative to the plug 50 may also be changed.

Figure 19:
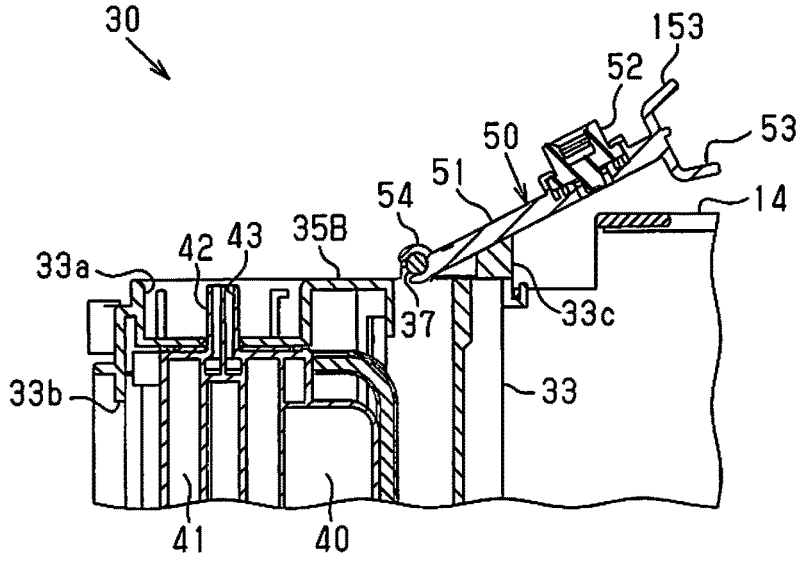
FIG. 19 is cross-sectional side view showing a structure for restricting the plug at the open position in a modified example of a liquid holding unit that does not include the cover.

Referring to FIG. 19, the cover 32 may be omitted from the housing 33. As shown in FIG. 19, the housing 33 includes a restriction portion 33*c* that contacts the holding member 51 when the plug 50 opens to restrict the pivot range of the holding member 51. The open angle of the plug 50 is, for example, preferably in the range from 95 to 170 degrees and more preferably in the range from 100 to 150 degrees. Further, as shown in FIG. 19, the plug 50 may include a projection that extends from the holding member 51 in a direction opposite to the tab 53. The projection may function as a tab 153 that is held by the user. In this example, the distal end of the holding member 51 is bifurcated to form the tab 53 and the tab 153. A tab may be located at any position on the holding member 51 as long as the tab can be held by the user. In a structure that includes the cover 32, the holding member 51 may contact the restriction portion 33*c* to restrict the pivot range of the plug 50.

The operation of the liquid holding unit 30 and the liquid ejection device 12 will now be described.

In the liquid ejection device 12, the medium M fed from the medium cassette 19 is transferred in the transfer direction Y. Further, the liquid ejector 21 ejects liquid onto the medium M when the medium M is being transferred to print, for example, an image on the medium M. A controller (not shown) of the liquid ejection device 12 stores the present liquid amount of each liquid holder 40 remaining from the previous operation. The controller subtracts the consumed liquid amount of each liquid holder 40 from the previous liquid amount of the liquid holder 40. When the liquid amount of a liquid holder 40 becomes less than a threshold value for the lower limit of the liquid amount (e.g., near end), the controller shows a message on the display unit 17 indicating such a situation and prompts the user to fill the liquid holder 40 with liquid. The user fills the liquid holders 40 indicated on the display unit 17 with liquid.

When filling the liquid holders 40 with liquid, the user first opens the image reading device 13 and then opens the cover 32. This exposes the plugs 50 of the liquid holders 40 to the outside. In the examples in which the covering 65 of the holding member 51 of the plug 50 indicates the liquid color (FIGS. 14 to 17), the plug 50 corresponding to the liquid holder 40 that is to be filled with liquid can be located based on, for example, the color indicated by the covering 65, namely, the coloring or the color information. Thus, the user selects and opens the appropriate one of the plugs 50. The user can hold the tab 53 of the selected plug 50 to open the plug 50. The tab 53 allows for easy opening of the plug 50. Further, the tab 53 is located closer to the first end (distal end) of the holding member 51 than the plug body 52. Thus, application of liquid from the plug body 52 to the fingers is limited. The user moves the appropriate plug 50 to open the corresponding inlet 43 and fills the liquid holder 40 with liquid through the inlet 43.

When filling the liquid holder 40 with liquid, the user checks the liquid surface height (liquid level) from the outer side of liquid holding unit 30 and pours the liquid until reaching, for example, an upper limit position. When the filling of the liquid holder 40 with liquid is completed, the user closes the plug 50. Here, the plug 50, which is located at the open position when filling the liquid holder 40 with liquid, is in contact with the restriction portion 39 or 33*c* so that further movement of the plug 50 is restricted. At the open position, the plug 50 is held at a predetermined open angle (e.g., predetermined angle in range from 90 to 170 degrees), preferably, at a predetermined open angle in the range from 95 to 150 degrees (refer to FIGS. 18 and 19). Thus, when closing the plug 50 held at the open angle, contact of the fingers holding the tab 53 with the bottom portion of the plug body 52 is limited. This limits the liquid that is applied to the fingers. Further, the holding member 51 of the plug 50 is tilted at the predetermined open angle. This easily avoids situations in which the user inadvertently places his or her hand on the plug 50 and breaks the plug 50 as compared with when the plug 50 lies horizontally at an open angle of approximately 180 degrees. Particularly, in the structure in which contact of the plug 50 with the restriction portion 39 inside the cover 32 restricts the pivot range, the open angle is easily set to the preferred range from 100 to 150 degrees in order to further limit the liquid applied from the plug body 52 to the fingers and further reduce the breaking frequency of the plug 50.

The holding member 51 has higher rigidity than the flexible plug body 52 and resists deformation when opening the plug 50. This limits the liquid applied from the plug body 52 to the fingers. For example, when the rigidity of holding member is less than or equal to the flexible plug body, the holding member 51 deforms when opening or closing the plug 50 and vibrates the plug body 52. In such a case, liquid is easily applied from the plug body 52 to the fingers of the user. In the present embodiment, the holding member 51, which has higher rigidity than the plug body 52, resists deformation when opening or closing the plug 50, and limits vibration of the plug body 52. This limits the liquid that is applied from the plug body 52 to the fingers or the like and easily positions the plug body 52 relative to the inlet 43. Further, when the distal side of the plug body 52 includes the guide surface 61*a* (refer to FIG. 8) that corresponds to the tube 42, the plug body 52 securely closes the tube 42 even when the plug body 52 and the tube 42 are slightly misaligned from each other. In addition, the plug body 52 is formed from an elastically deformable member. This ensures that the plug body 52 seals the inlet 43.

Further, the engagement of the shaft 37 with the engagement portion 54 allows the plug 50 to be pivotal relative to the housing 33 or the corresponding liquid holder 40. Thus, when holding the distal end of the holding member 51 (e.g., tab 53) to open or close the plug 50, the law of the lever reduces the force required to open or close the plug 50. This allows the plug 50 to be easily opened or closed with a relatively small force.

In each plug 50 shown in FIGS. 7 to 13, the coupling mechanism 60 that couples the two projections 62 (keys) and the two grooves 64 (key grooves) are employed to couple the holding member 51 and the plug body 52. Thus, when coupling the plug body 52 to the holding member 51 in a manufacturing plant, the fitted portion 63 of the plug body 52 is fitted into the through hole 51*a* in the holding member 51 of the plug body 52. Then, the plug body 52 is rotated so that the two projections 62 engage the two grooves 64. This couples the holding member 51 and the plug body 52, which are formed by members that differ from each other in rigidity, in a relatively simple manner. Thus, the plug 50 is manufactured in a relatively simple manner.

The first embodiment has the advantages described below.

(1) The liquid holding unit 30, which supplies liquid to the liquid ejector 21 of the liquid ejection device 12, includes the liquid holders 40 holding liquid, the housing 33 that accommodates the liquid holders 40, the inlets 43 used to fill the corresponding liquid holders 40 with liquid, and the plugs 50 that open and close the corresponding inlets 43. Each plug 50 includes the elastically deformable plug body 52 that covers the corresponding inlet 43 and the holding member 51 that has higher rigidity than the plug body 52 and holds the plug body 52. Thus, when the user opens or closes the plug 50 to fill the corresponding liquid holder 40 with liquid, the frequency is reduced in which the liquid is applied from the plug body 52 to the fingers or the like of the user.

(2) The holding member 51 includes the first end 511, the second end 512, and the side ends 513 that intersect the first end 511 and the second end 512. The first end 511 includes the tab 53 used to open or close the corresponding inlet 43. Thus, the user holds the tab 53 between fingers to open or close the plug 50. This facilitates the opening and closing of the plug 50 and further reduces the frequency liquid is applied from the plug body 52 to the fingers when opening and closing the plug body 52.

(3) The plug body 52 is located between the tab 53 and the second end 512 of the holding member 51. Thus, when the user opens or closes the plug 50, situations are reduced in which the user inadvertently touches the portion of the plug body 52 at the side that seals the inlet 43. This further avoids the application of liquid from the plug body 52 to the fingers of the user.

(4) The liquid holding unit 30 includes the plugs 50 respectively corresponding to the liquid holders 40. Each of the plugs 50 includes a single plug body 52 for the corresponding liquid holder 40. Since each liquid holder 40 is independently opened and closed by the corresponding plug 50, the frequency is further reduced in which liquid is applied from the plug body 52 to the fingers of the user when opening or closing the plug 50 as compared to a structure in which multiple plugs are formed integrally with one another. This also reduces the evaporation or volatilization of liquid from the liquid holders 40 other than the one that is filled with liquid.

(5) The liquid holding unit 30 includes the shafts 37 that are used to pivot the corresponding plugs 50 and the engagement portions 54 that are engaged with the corresponding shafts 37. The housing 33 includes either one of the shafts 37 and the engagement portions 54, and the plugs 50 include the other one of the shafts 37 and the engagement portions 54. Thus, when the user opens or closes a plug 50 while holding the distal end of the corresponding holding member 51, the law of the lever reduces the force required to open or close the plug 50.

(6) The cover 32 includes the restriction portion 39, and the housing 33 includes the restriction portion 33*c*. In a state in which each holding member 51 is pivoted in a direction that opens the corresponding inlet 43, the restriction portion 39 or 33*c* contacts the holding member 51 and restricts the pivot range of the holding member 51. Such a structure reduces the application of liquid from the plug body 52 to the fingers or the like of the user when opening or closing the plug 50 compared to when, for example, a structure in which the pivot range of the holding member 51 is not restricted and the plug 50 is pivoted by approximately 180 degrees lying horizontally at the open position. This further reduces the frequency in which liquid is applied from the plug body 52 to the fingers or the like of the user. Further, the opening and closing amount of the plug 50 is relatively decreased, and the liquid holder 40 is easily filled with liquid. Moreover, in a structure in which a plug lies horizontally at the open position, the user may inadvertently place his or her hand on the plug and break the plug. However, in the present example, the plug 50 is held at a tilted position at the open position (e.g., position where open angle is 95 to 170 degrees). This decreases the possibility of the user inadvertently placing his or her hand on the plug 50 and reduces situations in which the user inadvertently breaks the plug 50.

(7) The holding member 51 includes the covering 65 that covers the upper opening of the through hole 51*a* and is in correspondence with the color of the liquid held in the corresponding liquid holder 40. The covering 65 functions to conceal the through hole 51*a* of the holding member 51 and indicate the color. This improves the aesthetic appeal of the plug 50. Further, the user can check the color of the liquid by looking at the covering 65. This reduces errors in which the liquid holders 40 are filled with liquid of the wrong colors.

(8) The liquid ejection device 12 includes the liquid holding unit 30 and the liquid ejector 21 that ejects the liquid supplied from the liquid holders 40 in the liquid holding unit 30. When the consumption of liquid by the liquid ejector 21 results in the need to fill the liquid holders 40 with liquid, the liquid ejection device 12 has the advantages of the liquid holding unit 30.

Second Embodiment

A liquid holding unit of a second embodiment will now be described with reference to the drawings. Same reference numerals are given to those components that are the same as the corresponding components of the first embodiment. Such components will not be described in detail. The description hereafter will focus on differences from the first embodiment.

Figure 20:
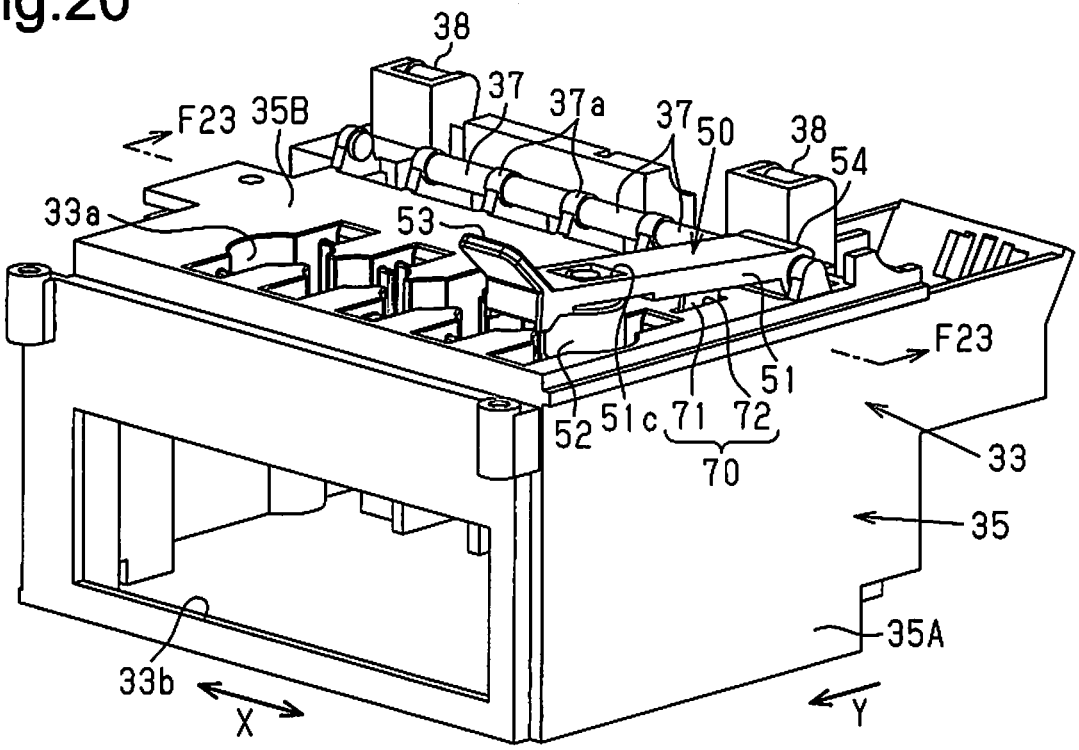
FIG. 20 is a perspective view showing a portion of a housing to which a plug is coupled in a liquid holding unit of a second embodiment.
Figure 21:
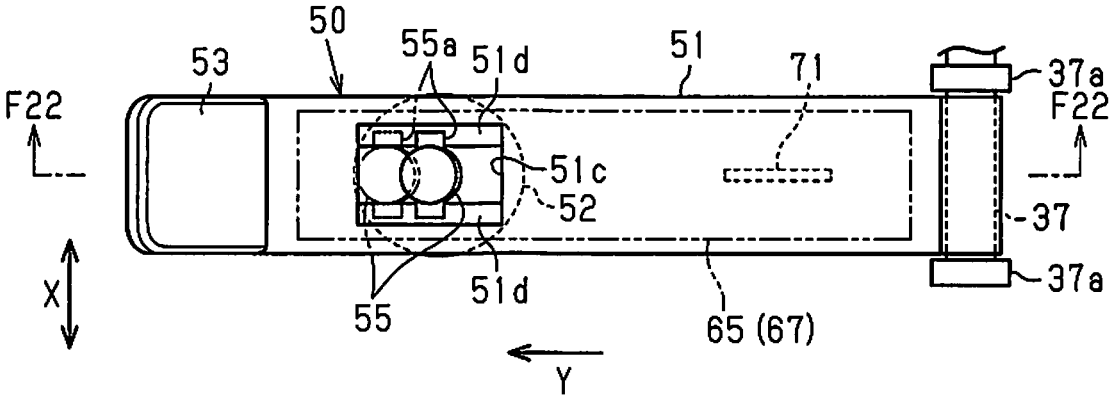
FIG. 21 is a plan view showing the plug of FIG. 20.

As shown in FIG. 20, the liquid holding unit 30 includes a positioning guide 70 for each plug 50. The positioning guide 70 includes a projection 71 and a recess 72. In a state in which the inlet 43 is closed by the corresponding plug 50 (refer to FIG. 22), the projection 71 is inserted into the recess 72 to guide and position the plug 50 relative to the inlet 43. The holding member 51 includes one of the projection 71 and the recess 72, and the corresponding liquid holder 40 or the housing 33 includes the other one of the projection 71 and the recess 72. In the example shown in FIGS. 20 to 23, the holding member 51 includes the projection 71, and the housing 33 includes the recess 72. In detail, as shown in FIG. 20, the surface of the holding member 51 opposing the housing 33 includes the projection 71, and the upper surface of the housing 33 includes the recess 72. The projection 71 is inserted in the recess 72 when the plug 50 is located at the close position. As shown in FIGS. 20 and 21, the holding member 51 of the plug 50 is elongated in a single direction in the same manner as the first embodiment.

Figure 22:
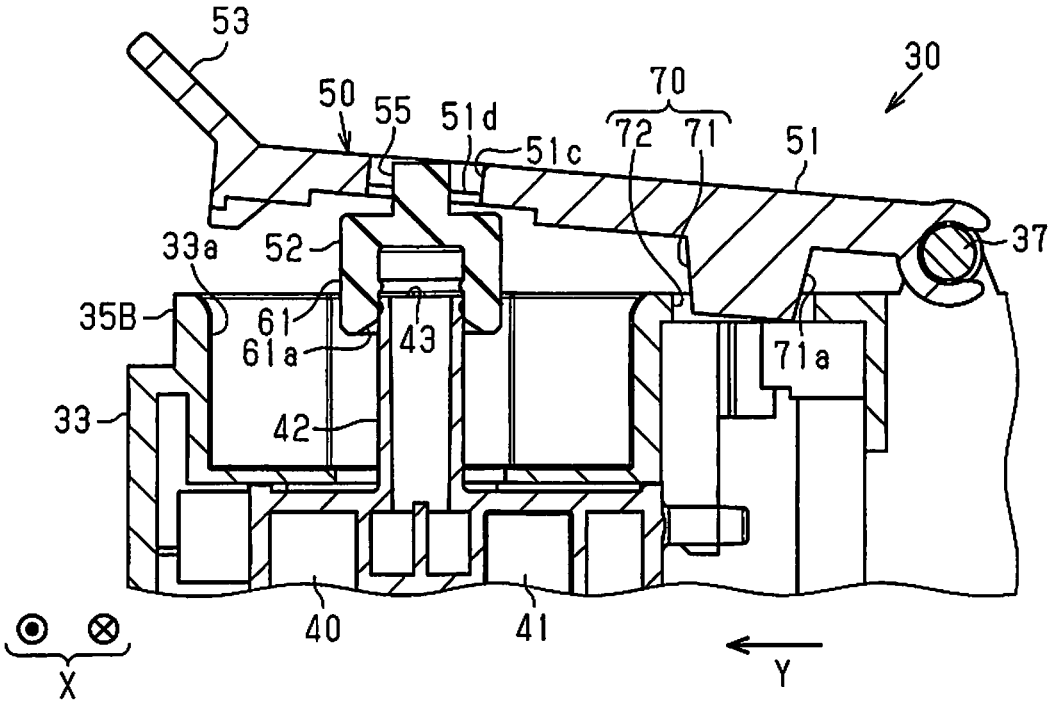
FIG. 22 is a cross-sectional view taken along line F22-F22 in FIG. 21.
Figure 23:
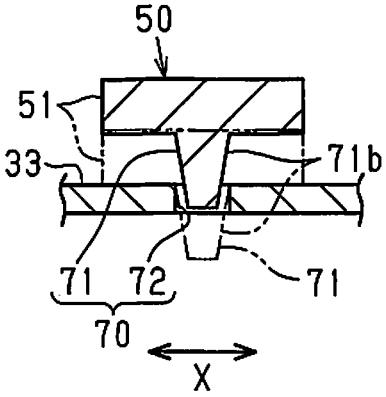
FIG. 23 is a cross-sectional view taken along line F23-F23 in FIG. 20.

As shown in FIG. 22, the projection 71 includes a tapered guide surface 71*a* having a dimension in the longitudinal direction of the holding member 51 that decreases toward the distal side. Thus, when closing the plug 50, the plug 50 is guided and positioned in the longitudinal direction of the plug 50 as the projection 71 enters the recess 72. As shown in FIG. 23, the projection 71 includes the tapered guide surface 71*b* having a dimension in the widthwise direction X that decreases toward the distal side. Thus, when closing the plug 50, the plug 50 is guided and positioned in the widthwise direction X as the projection 71 enters the recess 72. In this manner, when closing the plug 50, the plug body 52, which is held by the holding member 51, is positioned relative to the tube 42 of the corresponding liquid holder 40. This ensures that the plug body 52 is fitted onto the tube 42. Instead of the projection 71, the inner surfaces of the recess 72 may form the guide surface. Further, the positioning guide 70 need only include at least one of a guide surface that guides the holding member 51 in the longitudinal direction and a guide surface that guides the holding member 51 in the widthwise direction X. For example, the positioning guide 70 may include only one of the guide surfaces.

The positioning guide 70 guides and positions the plug body 52. However, when the position where the holding member 51 is coupled or the position where the plug body 52 and the holding member 51 are coupled differs from the intended position, the plug body 52 may be displaced and separated from the inlet 43 even though the positioning guide 70 guides and positions the plug body 52. Thus, in the plug 50 of the present embodiment, the plug body 52 is held so as to be movable relative to the holding member 51 in the longitudinal direction.

As shown in FIGS. 21 and 22, the plug body 52 includes a rod 55 that projects from the plug body 52 at the side opposite to the portion that seals the corresponding inlet 43. The rod 55 includes two rod guides 55*a* (refer to FIG. 21) that project from opposites sides of the rod 55 in the widthwise direction X. The holding member 51 includes a rectangular guide hole 51*c* (through hole) and two recesses 51*d*. The guide hole 51*c* guides the rod 55 in the longitudinal direction of the holding member 51 in a state in which the rod 55 is inserted into the guide hole 51*c*. The recesses 51*d* are located at opposite sides of the guide hole 51*c* in the widthwise direction X and extend in the longitudinal direction of the holding member 51. The plug body 52 is coupled to the holding member 51 in a state in which the rod 55 is inserted into the guide hole 51*c* and the two rod guides 55*a* are placed on the bottom surfaces of the corresponding recesses 51*d*. The rod 55 is movable along the guide hole 51*c* in the longitudinal direction of the holding member 51. This provides a certain degree of freedom for the position of the plug body 52 in the longitudinal direction of the holding member 51. Further, in the present example, the width of the guide hole 51*c* is slightly greater than the outer diameter of the rod 55, and the plug body 52 is movable in the widthwise direction X relative to the holding member 51. This provides a certain degree of freedom for the position of the plug body 52 in the widthwise direction X relative to the holding member 51.

When closing the plug 50, the projection 71, which is inserted into the recess 72, positions the holding member 51 in the longitudinal direction of the holding member 51 and in the widthwise direction X. Thus, even if the plug body 52 is displaced by a maximum amount relative to the tube 42, when the plug body 52 is moved in the closing direction, the guide surface 61*a* of the plug body 52, which contacts the tube 42, guides and positions the plug body 52 in the longitudinal direction of the holding member 51 and the widthwise direction X so that the plug body 52 is fitted onto the tube 42.

When closing the plug 50 in this manner, the insertion of the projection 71 into the recess 72 positions the plug 50 at the proper position in at least one of the longitudinal direction and the widthwise direction X. Further, the plug body 52 is movable relative to the holding member 51 and is provided with a certain degree of freedom in position relative to the corresponding inlet 43. This ensures that the plug body 52 seals the inlet 43. More specifically, when closing the inlet 43 with the plug 50, the projection 71, which is inserted in the recess 72, guides and positions the plug 50 relative to the inlet 43. This obviates the entrance of foreign matter into the liquid holder 40 and the evaporation or volatilization of liquid out of the liquid holder 40 that would result from defective sealing of the inlet 43.

Figure 24:
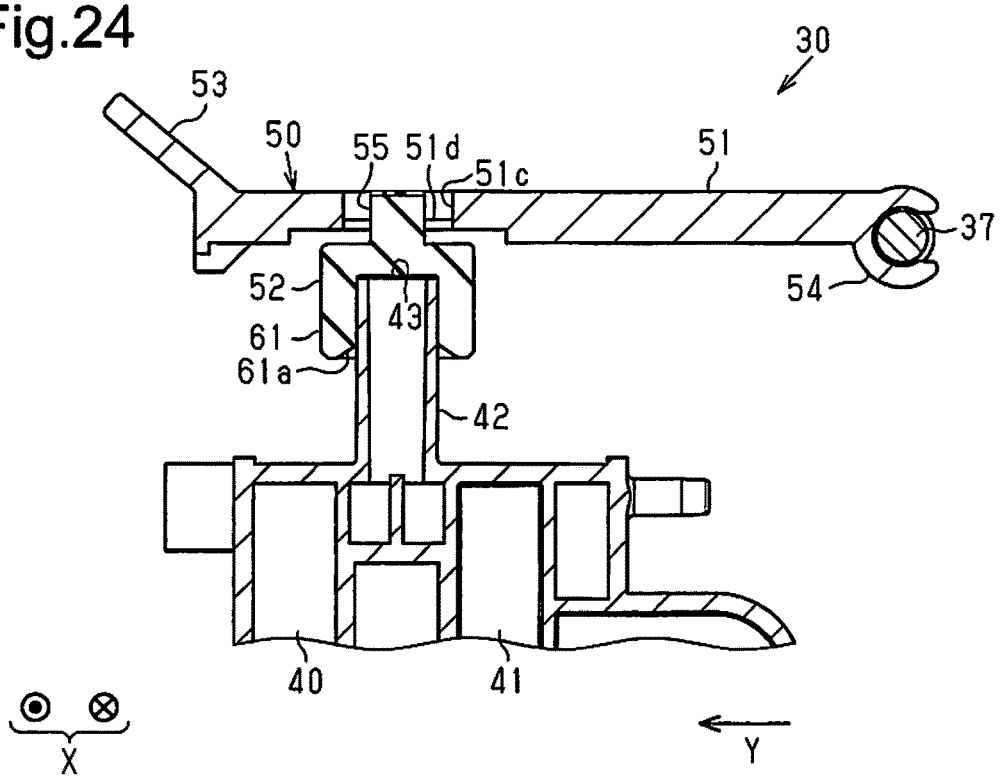
FIG. 24 is a cross-sectional side view showing a modified example of a liquid holding unit that does not include a positioning guide.

The positioning guide 70 may be omitted as shown in FIG. 24. In this structure, the plug body 52 is movable along the guide hole 51*c* relative to the holding member 51. Further, the plug body 52 is provided with a certain degree of freedom in position in at least one of the longitudinal direction of the holding member 51 and the widthwise direction X. Thus, engagement of the guide surface 61*a* with the tube 42 moves the plug body 52 relative to the holding member 51 and guides and positions the plug body 52 relative to the holding member 51. This ensures that the plug body 52 seals the corresponding inlet 43.

Figure 25:
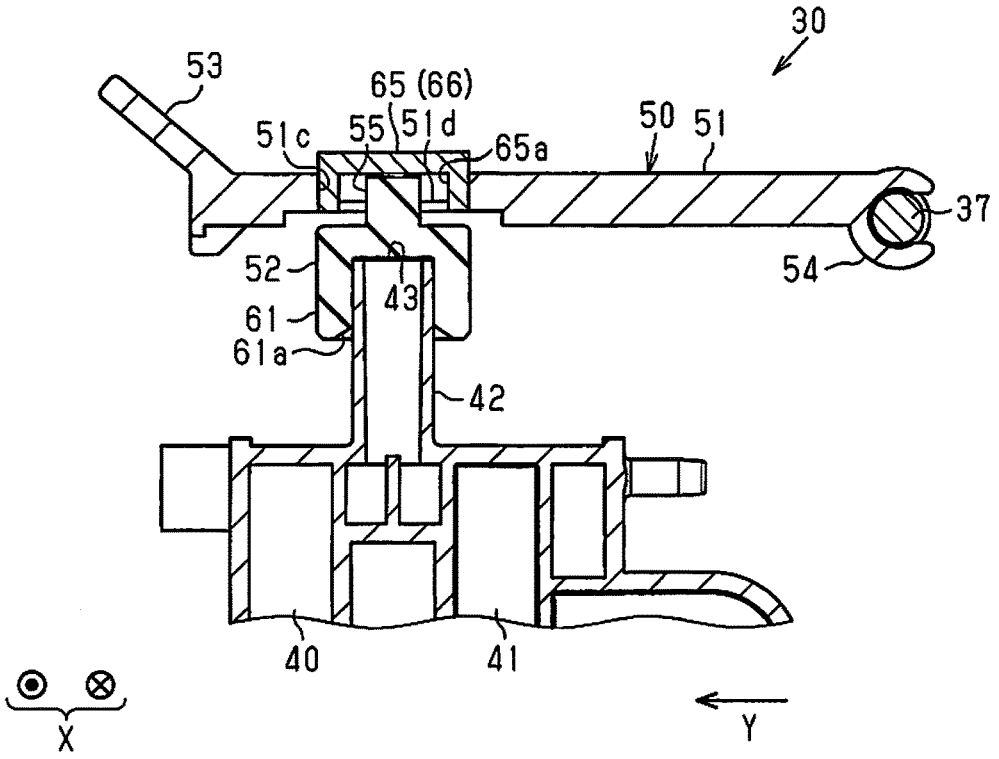
FIG. 25 is a cross-sectional side view showing a modified example of a plug that includes the covering.

Further, as shown in FIG. 25, the guide hole 51*c* of the holding member 51 may be covered by the covering 65. In the example of FIG. 25, as one example of the covering 65, the cap 66 is fitted into the guide hole 51*c*. The rod 55 is formed to contact the inner wall surface 65*a* of the cap 66. This obtains a fitting margin for the cap 66 and restricts the movement range of the plug body 52. In the present example, the movable range of the plug body 52 set by the inner wall surface 65*a* of the cap 66, which is fitted in the guide hole 51*c*, is the same in the structure of FIGS. 21 to 24 that does not have the cap 66. Instead of the cap 66, the label 67 shown in FIGS. 16 and 17 may be applied as the covering 65 to the holding member 51.

In addition to advantages (1) to (8), the second embodiment has the advantages described below.

(9) The holding member 51 is elongated in one direction and holds the plug body 52 so that the plug body 52 is movable in the longitudinal direction of the holding member 51. This provides the plug 50 with a certain degree of freedom in position relative to the holding member 51 in the longitudinal direction of the holding member 51. Thus, when the plug body 52 is fitted to the corresponding inlet 43 or when the plug body 52 contacts the inlet 43, the plug body 52 is moved relative to the holding member 51 and guided and positioned relative to the inlet 43 to ensure that the inlet 43 is sealed. This reduces the frequency in which defective sealing of the inlet 43 occur and obviates, for example, the entrance of foreign matter into the liquid holder 40 and the evaporation or volatilization of liquid out of the liquid holder 40 that would result from defective sealing of the inlet 43.

(10) The liquid holding unit 30 includes the positioning guide 70. The positioning guide 70 includes the projection 71 and the recess 72 that guide and position the plug 50 relative to the inlet 43 when the projection 71 is inserted into the recess 72 in a state in which the inlet 43 is closed by the plug 50. The holding member 51 includes one of the projection 71 and the recess 72, and the liquid holder 40 or the housing 33 includes the other one of the projection 71 and the recess 72. Thus, when moving the plug 50 from the open position to the close position and inserting the projection 71 into the recess 72, the plug 50 is positioned at the proper position. This ensures that the plug body 52 seals the corresponding inlet 43 and obviates the entrance of foreign matter into the liquid holder 40 and the evaporation or volatilization of liquid out of the liquid holder 40 that would result from defective sealing of the inlet 43.

Third Embodiment

A liquid holding unit of a third embodiment will now be described with reference to the drawings. Same reference numerals are given to those components that are the same as the corresponding components of the first embodiment. Such components will not be described in detail. The description hereafter will focus on differences from the first embodiment.

Figure 26:
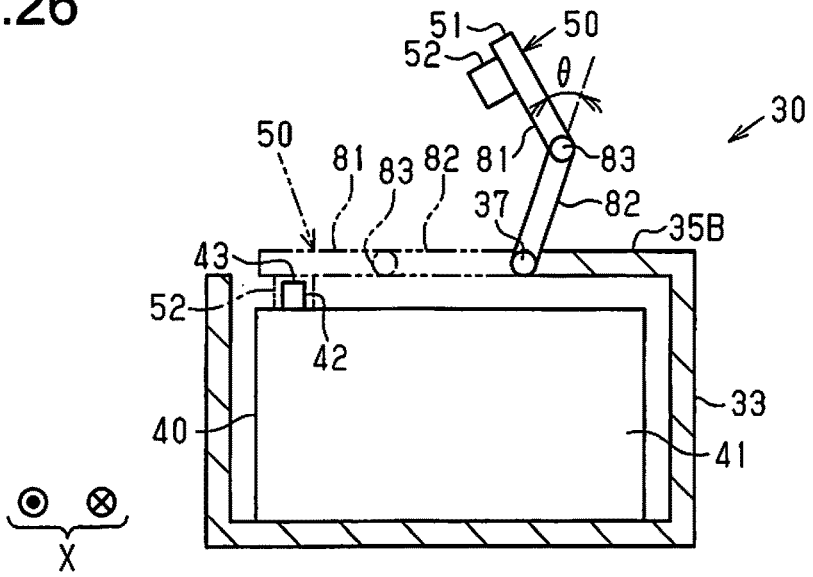
FIG. 26 is a cross-sectional side view schematically showing a liquid holding unit in a third embodiment.

As shown in FIG. 26, the holding member 51 of the plug 50 is bendable. In detail, the holding member 51 includes a first piece 81, a second piece 82, and a pivot 83. The first piece 81 is located toward a first end (distal end) of the holding member 51 and includes the plug body 52. The second piece 82 is located closer to the second end (basal end) of the holding member 51 than the first piece 81. The pivot 83 is located between the first piece 81 and the second piece 82 to pivot the first piece 81 relative to the second piece 82.

As shown in FIG. 26, in a state in which the plug 50 is located at the open position, the first piece 81 is pivoted relative to the second piece 82 about the pivot 83 by a predetermined angle in the direction in which the plug body 52 approaches the corresponding inlet 43, and the holding member 51 is in a bent formation as shown by the solid lines in FIG. 26. The state in which the plug 50 is located at the open position refers to a state in which the plug 50 opens the inlet 43. In a state in which the plug 50 is located at the close position, the first piece 81 and the second piece 82 are arranged straight about the pivot 83, and the holding member 51 is in a straight formation as shown by the double-dashed lines in FIG. 26. The state in which the plug 50 is located at the close position refers to a state in which the plug 50 is sealing the inlet 43. As shown in FIG. 26, when the first piece 81 is bent toward the inlet 43 by angle about the pivot 83 from a state in which the first piece 81 is flush with the second piece 82 as shown by the single-dashed line, a restriction portion (not shown) restricts further pivoting (bending) of the first piece 81. When the holding member 51 is in the straight formation as shown by the double-dashed line in FIG. 26, a restriction portion (not shown) restricts pivoting (bending) of the first piece 81 so that the first piece 81 does not move away from the inlet 43. In this manner, the first piece 81 is bendable relative to the second piece 82 within an angular range set between the straight formation shown by the double-dashed lines in FIG. 26 and the bent formation shown by the solid lines in FIG. 26. In a state in which the holding member 51 is located at the open position as shown by the solid lines in FIG. 26, the second piece 82 is in contact with a restriction portion of the cover 32 or the housing 33. This holds the second piece 82 at a predetermined open angle as shown in FIG. 26.

When the plug 50 is located at the close position, the first piece 81 and the second piece 82 are in the straight formation as shown by the double-dashed lines in FIG. 26, and the plug body 52 seals the inlet 43. As the user holds the first end (distal end) of the holding member 51 between his or her fingers and moves the plug 50 from the close position to the open position, the force applied from the fingers to the first piece 81 pivots (bends) the first piece 81 relative to the second piece 82 and transforms the holding member 51 from the straight formation to the bent formation. In the bent formation, the plug body 52 is directed diagonally downward. This limits the liquid applied from the plug body 52 to the fingers or the like of the user.

Figure 27:
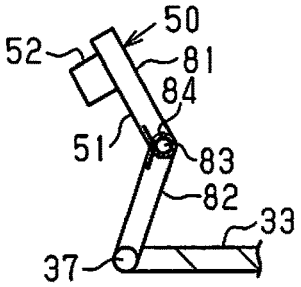
FIG. 27 is a cross-sectional side view schematically showing an example of a plug including an urging member.

Preferably, as shown in the example of FIG. 27, an urging member 84 is arranged on the holding member 51 to urge the first piece 81 relative to the second piece 82 in a direction in which the holding member 51 bends from the straight formation to the bent formation. In this structure, when the user opens the plug 50, the urging force of the urging member 84 automatically transforms the holding member 51 from the straight formation to the bent formation, and there is no need to adjust the force that is applied to bend the holding member 51 from the straight formation to the bent formation. As a result, when opening and closing the plug 50, the application of liquid from the plug body 52 to the fingers or the like is further limited. The urging member 84 may be a torsion spring as shown in FIG. 27. Alternatively, a coil spring, a rubber member, or the like may be used as the urging member 84. Further, the urging member 84 need not be arranged between the first piece 81 and the second piece 82 and may be arranged between the first piece 81 and the housing 33 or between the first piece 81 and the liquid holder 40.

Figure 28:
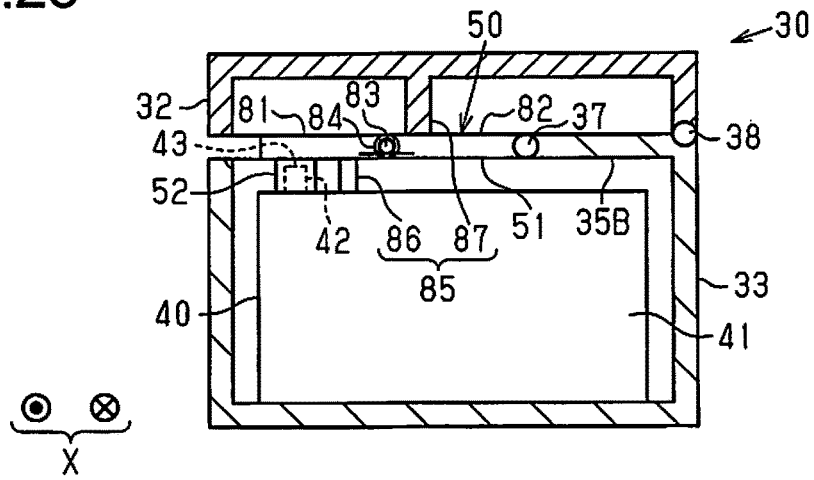
FIG. 28 is a cross-sectional side view schematically showing another structure of a liquid holding unit.

In this case, preferably, as shown in FIG. 28, the liquid holding unit 30 includes the cover 32 that covers the plug 50 in a closed state shown in FIG. 28 and exposes the plug 50 in an open state. The cover 32 includes a formation holding mechanism 85 that contacts at least one of the first piece 81 and the second piece 82 in a state in which the plug 50 seals the corresponding inlet 43 to hold the holding member 51 in the straight formation. In the example shown in FIG. 28, the formation holding mechanism 85 includes one or more abutment portions.

In detail, as shown in FIG. 28, the formation holding mechanism 85 includes a first rib 86 and a second rib 87 that serve as examples of abutment portions. When the plug 50 is located at the close position, the first rib 86 contacts the surface (lower surface) of the first piece 81 that opposes the inlet 43. When the cover 32 is in the closed state, the second rib 87 contacts the surface (upper surface) of the second piece 82 that is opposite to the rear surface. More specifically, the first rib 86 contacts the first piece 81 from below in the vertical direction, and the second rib 87 contacts the second piece 82 from above in the vertical direction. In the example shown in FIG. 28, the liquid holder 40 includes the first rib 86, and the cover 32 includes the second rib 87. The formation holding mechanism 85 may be formed by a single abutment portion that contacts the surface of the first piece 81 at the opposite side of the surface (rear surface) opposing the inlet 43 or be formed by just one second rib 87. Further, in FIG. 28, the cover 32 may include the first rib 86 that contacts the upper surface of the first piece 81. Further, the abutment portion that contacts at least one of the first piece 81 and the second piece 82 is not limited to a rib and may be a projection other than a rib, the inner surface of the cover 32, a portion of the liquid holder 40 other than a rib, a rib of the housing 33, or a portion of the housing 33 other than a rib.

In this manner, the plug 50 is held in the straight formation when the cover 32 is closed. This maintains the plug 50 in the closed state against the urging force of the urging member 84. Thus, for example, the urging force of the urging member 84 does not move the plug 50 in the opening direction after the cover 32 is closed. This avoids situations in which the plug 50 moves and opens the corresponding inlet 43. Although not shown in the examples of FIGS. 26 to 28, the holding member 51 preferably includes the tab 53 of the first embodiment at the first end (distal end). Further, when holding the plug body 52 on the holding member 51 with the same coupling structure as the first embodiment, it is preferred that the first piece 81 of the holding member 51 include the covering 65 that covers the upper opening of the through hole 51*a*.

In addition to advantages (1) to (8) of the first embodiment, the third embodiment has the advantages described below.

(11) The holding member 51 includes the first piece 81 located toward the first end of the holding member 51 and provided with the plug body 52, the second piece 82 located closer to the second end of the holding member 51 than the first piece 81, and the pivot 83 located between the first piece 81 and the second piece 82. In a state in which the plug 50 is located at the open position, the holding member 51 is in the bent formation in which the first piece 81 is pivoted relative to the second piece 82 about the pivot 83 in the direction in which the plug body 52 approaches the corresponding inlet 43. In a state in which the plug 50 is located at the close position, the holding member 51 is in the straight formation in which the first piece 81 and the second piece 82 are arranged straight. When opening the plug 50, the holding member 51 takes the bent formation so that the plug body 52 is directed toward the inlet 43. Thus, when opening and closing the plug 50, the application of liquid from the plug body 52 to the fingers of the user is limited. Thus, when opening and closing the plug 50 to fill the liquid holder 40 with liquid, the frequency is further reduced in which liquid is applied from the plug body 52 to the fingers or the like of the user.

(12) The holding member 51 includes the urging member 84 that urges the holding member 51 in a direction in which the holding member 51 bends from the straight formation to the bent formation. Thus, when opening the plug 50, the holding member 51 is arranged in the bending formation without the need for the user to adjust the force applied to the holding member 51 to bend the holding member 51. This further reduces the frequency in which liquid is applied from the plug body 52 to the fingers or the like of the user when opening and closing the plug 50.

(13) The liquid holding unit 30 includes the cover 32, which opens to expose the plug 50 and closes to cover the plug 50, and the formation holding mechanism 85, which contacts at least one of the first piece 81 and the second piece 82 when the cover 32 is closed to hold the holding member 51 in the straight formation at the close position. Thus, even when the urging member 84 is urged in a direction in which the holding member 51 takes the bent formation, when closing the cover 32 after the plug 50 is arranged at the close position, the formation holding mechanism 85 contacts at least one of the first piece 81 and the second piece 82 to hold the holding member 51 in the straight formation and keep the holding member 51 closed. This reduces the occurrence of defective sealing that result from the urging force of the urging member 84 that acts to remove the plug body 52 from the inlet 43. This obviates the entrance of foreign matter into the liquid holder 40 and the evaporation or volatilization of liquid out of the liquid holder 40 that would result from defective sealing of the inlet 43.

Fourth Embodiment

Figure 29:
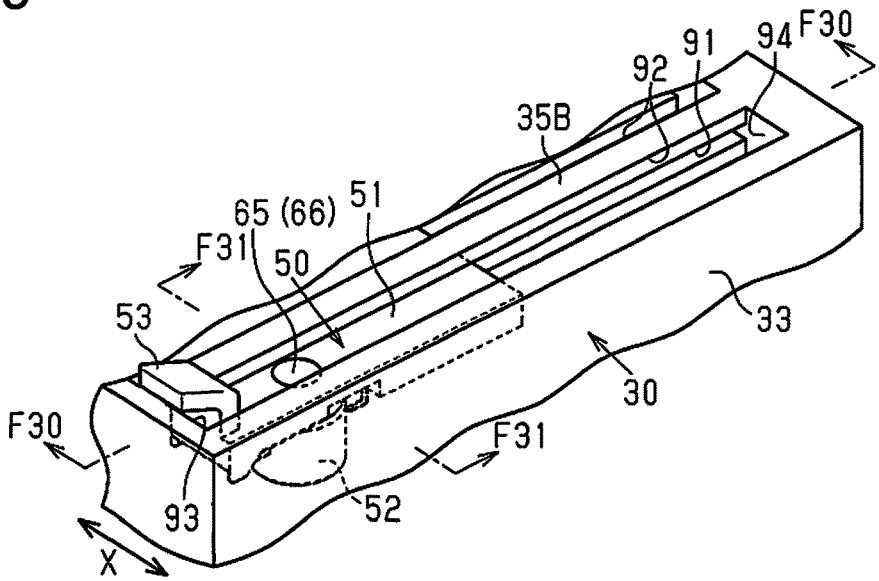
FIG. 29 is a perspective view showing, in part, a liquid holding unit in a fourth embodiment.
Figure 30:
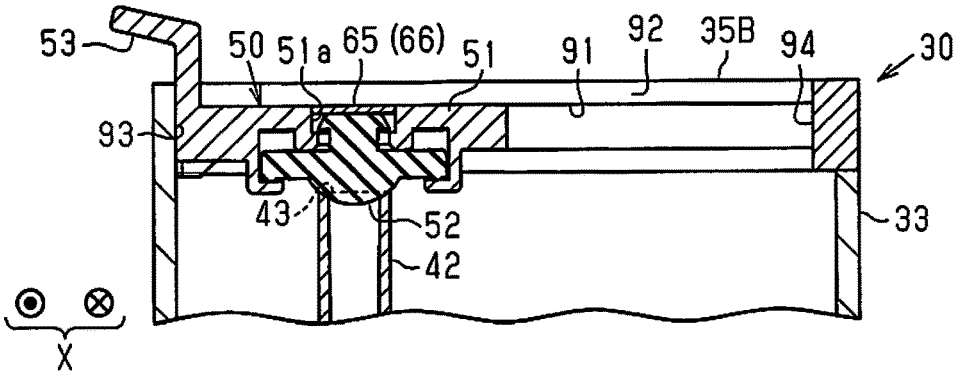
FIG. 30 is a cross-sectional view taken along line F30-F30 in FIG. 29.
Figure 31:
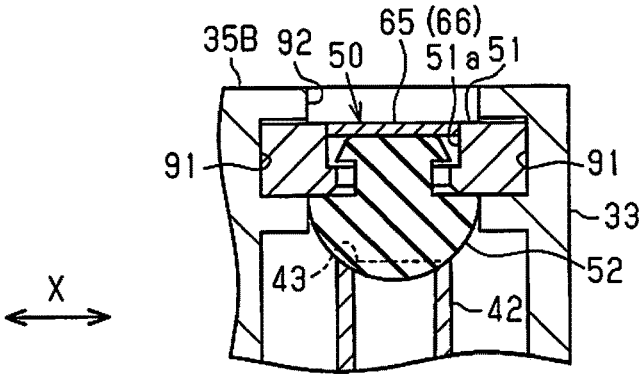
FIG. 31 is a cross-sectional view taken along line F31-F31 in FIG. 29.

A liquid holding unit of a fourth embodiment will now be described with reference to the drawings. Same reference numerals are given to those components that are the same as the corresponding components of the first embodiment. Such components will not be described in detail. The description hereafter will focus on differences from the first embodiment. FIGS. 29 to 31 show the plug 50 of only one of the liquid holders 40 in the liquid holding unit 30. The description hereafter will focus on the shown plug 50 that is identical to the other plugs 50.

Referring to FIG. 29, in the present embodiment, the plug 50 is slidable. The housing 33 or the liquid holder 40 (refer to FIG. 5) includes guides 91 that hold the holding member 51 of the plug 50 in a slidable manner. The guides 91 hold the holding member 51 in a slidable manner. In the example shown in FIG. 29, the housing 33 includes the guides 91, and the holding member 51 is held to be slidable relative to the housing 33. In detail, as shown in FIGS. 29 to 31, the lid 35B of the housing 33 includes a through hole 92 that is rectangular and elongated in the longitudinal direction of the holding member 51. The through hole 92 is defined by two inner walls that oppose each other in the widthwise direction X. Each inner wall is recessed and defines one of the two guide 91.

The holding member 51 has higher rigidity than the elastically deformable plug body 52 and is elongated in one direction. The two sides of the holding member 51 in the widthwise direction X are partially inserted into the two guides 91 and held in a manner slidable relative to the housing 33. The plug body 52 moves together with the holding member 51 in a sliding direction. Referring to FIGS. 30 and 31, the direction in which the holding member 51 and the plug body 52 are slidable is parallel to the plane of the opening of the inlet 43. The guides 91 may be projections instead of grooves, and the side walls of the holding member 51 may include grooves. In such a case, the guides 91 are engaged with the grooves to hold the holding member 51 in a slidable manner. Alternatively, the guides 91 may be rails, and the holding member 51 may slide on the rails. As another option, the holding member 51 may include rollers that roll on such rails.

Referring to FIGS. 30 and 31, the plug body 52 is fixed to the holding member 51. The plug body 52 is of the type shown in FIG. 12 that contacts and seals the inlets 43. Thus, even in a structure in which the holding member 51 slides, the plug body 52 seals the inlet 43 without interfering with the tube 42. One end (first end) of the holding member 51 includes the tab 53. The plug body 52 is located on the holding member 51 between the tab 53 and the outer end (second end). Preferably, as shown in FIGS. 29 to 31, the upper opening of the through hole 51*a*, into which the plug body 52 is partially fitted, is covered by the covering 65. In this case, the covering 65 is in correspondence with the color of the liquid held in the corresponding liquid holder 40 in the same manner as the first to third embodiments. The covering 65 may be the cap 66 shown in FIGS. 29 to 31 or the label 67 shown in FIGS. 16 and 17.

As shown in FIGS. 29 and 30, the liquid holding unit 30 includes restriction portions 93 and 94 that contact the holding member 51 and restrict the sliding range of the holding member 51. The restriction portions 93 and 94 may be arranged on the housing 33 or the liquid holder 40. In the present example in which the holding member 51 is slidable relative to the housing 33, the housing 33 includes the restriction portions 93 and 94. As shown in FIGS. 29 and 30, one of the restriction portions 93 and 94 (restriction portion 93 in FIGS. 29 and 30) is formed by part of the housing 33. The other one of the restriction portions 93 and 94 (restriction portion 94 in FIGS. 29 and 30) is attached in a removable manner to the housing 33 at a location corresponding to the longitudinal end of the guides 91. This allows the plug 50 to be coupled to the housing 33 along the guides 91 when the restriction portion 94 is removed from the housing 33. The restriction portion 94 is attached to the housing 33 after coupling the plug 50. This holds the plug 50 in a slidable manner with the slide range restricted. When the holding member 51 is held by the liquid holder 40 and slidable on the guides 91, it is preferred that the liquid holder 40 includes the restriction portions 93 and 94. However, the housing 33 may include at least one of the restriction portions 93 and 94.

When the user slides the plug 50 to open the inlet 43, the holding member 51 contacts the restriction portion 94. This restricts separation of the plug 50 from the guides 91. When the user slides the plug 50 to close the inlet 43, the holding member 51 contacts the restriction portion 93. This restricts separation of the plug 50 from the guides 91 and positions the plug body 52 at the close position where the inlet 43 can be sealed. In other words, the plug body 52 seals the inlet 43 by closing the holding member 51 until the holding member 51 contacts the restriction portion 93. For example, if the plug 50 falls out of the holding member 51, liquid may smear the location where the plug 50 falls. However, in the present embodiment, separation of the holding member 51 is restricted. Thus, the area around the liquid holding unit 30 is not smeared with liquid. One of the restriction portions 93 and 94 may be omitted. Even when, for example, one of the restriction portions 93 and 94 is omitted, the holding member 51 that slides will contact the remaining one of the restriction portions 93 and 94. This restricts separation of the holding member 51.

In addition to advantages (1) to (4), (7), and (8) of the first embodiment, the fourth embodiment has the advantages described below.

(14) In the liquid holding unit 30, the liquid holder 40 or the housing 33 includes the guides 91 that hold the holding member 51 of the plug 50 in a slidable manner. The guides 91 hold the holding member 51 in a slidable manner. The plug 50 slides to open or close the inlet 43. Thus, the plug body 52 does not have to be pulled off from the inlet 43, and the force required to open and close the plug 50 may be decreased. When opening the plug 50, the portion of the plug body 52 located at the side of the inlet 43 is not exposed to the outside. Thus, liquid is not applied to the fingers or the like of the user.

(15) The holding member 51 of the liquid holding unit 30 is elongated in one direction and holds the plug body 52 so that the plug body 52 is movable in the longitudinal direction of the holding member 51. Thus, the plug 50 provides a certain degree of freedom for the position of the plug body 52 in the longitudinal direction of the holding member 51. This ensures that the plug body 52 seals the inlet 43 and obviates, for example, the entrance of foreign matter into the liquid holder 40 and the evaporation or volatilization of liquid out of the liquid holder 40 that would result from defective sealing of the inlet 43.

(16) The liquid holder 40 or the housing 33 includes the restriction portions 93 and 94 that contact the holding member 51 and restrict the sliding range of the holding member 51. This avoids situations in which the plug 50 falls out of the liquid holder 40 or the housing 33 and smears the area where the plug 50 falls with liquid when moving the plug 50 along the guides 91.

It should be apparent to those skilled in the art that the present invention may be embodied in many other specific forms without departing from the spirit or scope of the invention. Particularly, it should be understood that the present invention may be embodied in the following forms.

Figure 32:
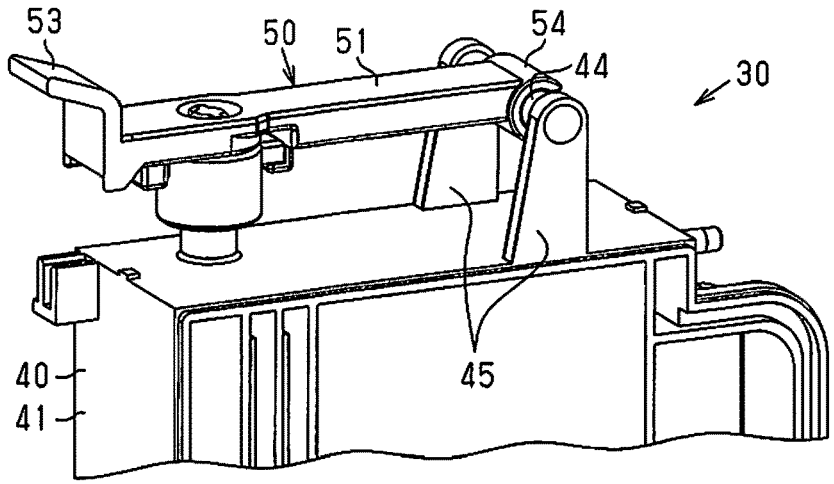
FIG. 32 is a perspective view showing a liquid holding unit in a modified example.
Figure 33:
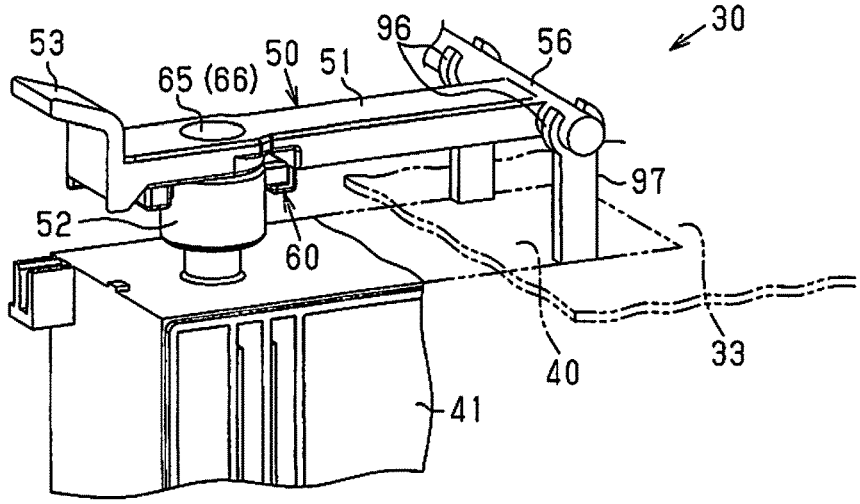
FIG. 33 is a perspective view showing a liquid holding unit in a modified example that differs from that of FIG. 32.

The liquid holder 40 or the housing 33 includes one of the shaft, which is used to pivot the plug, and the engagement portion, which is engaged with the shaft. The plug 50 includes the other one of the shaft and the engagement portion. For example, as shown in the modified example of FIG. 32, the liquid holder 40 may include a shaft 44, and the second end (basal end) of the plug 50 may include the engagement portion 54. The shaft 44 is supported by two supports 45 that extend from the holder body 41 of the liquid holder 40. Further, as shown in the modified example of FIG. 33, the second end (basal end) of the plug 50 may include a shaft 56, and the housing 33 or the liquid holder 40 may include an engagement portion 96 that engages the shaft 56. The engagement portion 96 is supported by two supports 97 extending from the holder body 41 or the housing 33 at positions opposing the shaft 56 of the plug 50 in a closed state. In FIG. 32 or 33, an axial displacement restriction portion restricts displacement of the holding member 51 in the axial direction of the shaft.

Figure 34:
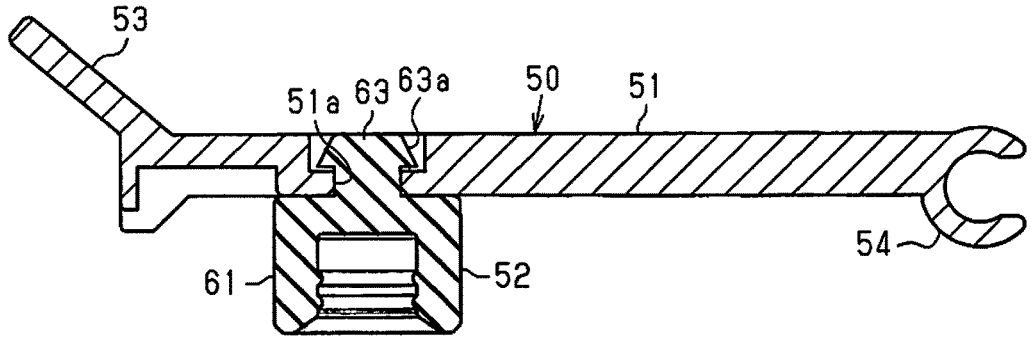
FIG. 34 is a cross-sectional side view showing a modified example of a structure coupling the holding member and the plug body.

The structure coupling the plug body 52 and the holding member 51 is not limited to the structures described in the above embodiments. For example, referring to FIG. 34, the plug body 52 may be partially fitted into the through hole 51*a* of the holding member 51. As shown in FIG. 34, the plug body 52 includes the fitted portion 63 at the opposite side of the plug portion 61, which seals the inlet 43. The fitted portion 63 is larger in diameter than the through hole 51*a*. The distal end of the fitted portion 63 includes the stopper 63*a*. The stopper 63*a* is inserted through the through hole 51*a*, and the basal portion of the stopper 63*a* is fitted to the through hole 51*a*.

Figure 35:
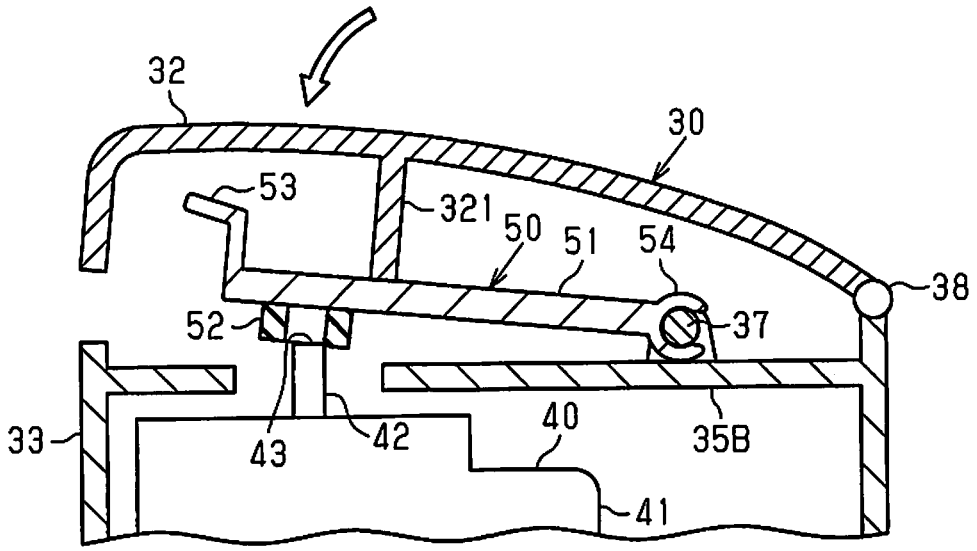
FIG. 35 is a cross-sectional side view schematically showing a liquid holding unit in a modified example that differs from that of FIG. 33.
Figure 36:
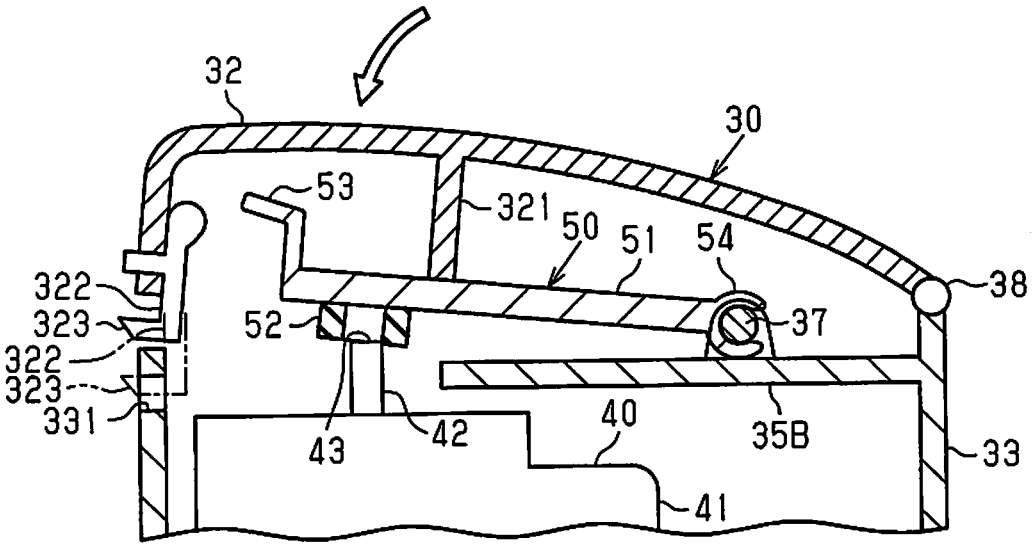
FIG. 36 is a cross-sectional side view schematically showing a liquid holding unit in a modified example that differs from that of FIG. 35.

As shown in FIGS. 35 and 36, in the liquid holding unit 30 that includes the cover 32, a pushing portion 321 may be arranged on the rear surface of the cover 32 to push the plug 50 toward the inlet 43 when closing the cover 32. The pushing portion 321 is retrofitted on the cover 32 or formed integrally with the cover 32. In the liquid holding unit 30 having such a structure, when the cover 32 is pivoted in the direction shown by the arrow in FIG. 35, the pushing portion 321 pushes the plug 50 in the closing direction. Thus, when the plug 50 is arranged above the closing position, the plug 50 is moved to the closing position. Additionally, once the cover 32 is closed, the plug 50 does not move away from the closing position even when force acting in the opening direction is applied to the plug 50. Thus, movement of the plug 50 from the closing position is limited. This prevents evaporation and volatilization of liquid. Further, when viewing the liquid ejection device 12 from the front (left side in FIGS. 35 and 36), the formation of a gap is limited between the cover 32 and the housing 33. This improves the aesthetic appeal of the liquid holding unit 30. In the liquid holding unit 30 shown in FIG. 36, an engagement member 322 is arranged on the cover 32. In a state in which the cover 32 is closed, the engagement member 322 engages the housing 33. More specifically, the engagement member 322, which is fixed to the distal end of the cover 32, includes an engagement projection 323. The housing 33 includes an engagement recess 331 at a portion corresponding to the engagement projection 323. The engagement recess 331 is engageable with the engagement projection 323. The cover 32 is pivoted and closed in the direction shown by the arrow in FIG. 36. As a result, the engagement projection 323 of the engagement member 322 is engaged with the recess 331 of the housing 33. This structure holds the cover 32 in a closed state and further limits movement of the plug 50 from the close position since the cover 32 is kept at the close position. Further, evaporation and volatilization of liquid are prevented. Moreover, when viewing the liquid ejection device 12 from the front (left side in FIGS. 35 and 36), the formation of a gap is limited between the cover 32 and the housing 33. This improves the aesthetic appeal of the liquid holding unit 30.

The housing may be formed integrally with the enclosure of the liquid ejection device.

The plug body 52 may be entirely fitted to the through hole 51*a* of the holding member 51.

In the first to third embodiments, the enclosure 14 may include a restriction portion that contacts the holding member 51 to restrict the pivot range of the plug 50.

In the first to third embodiments, a structure including a tubular shaft and rod-shaped engagement portions that are insertable into the two hollow ends of the shaft may be employed to pivotally hold the holding member 51. The engagement portions may be recessed or tubular so as to be engageable with the two ends of the shaft. The engagement portion of the holding member may be a tube, and a shaft may be inserted into and engaged with the tube. Such structures also pivotally hold the holding member 51.

The holding member 51 may be pivoted along a plane parallel to a plane lying along the opening of the inlet 43. In this case, the plug body 52 shown in FIG. 12 that contacts the inlet 43 may be used in the same manner as a slide-type. In the same manner as a slide-type, this structure reduces the force required to open and close the plug 50 and reduces the frequency in which liquid is applied from the plug body 52 to fingers or the like.

In the first to third embodiments, the holding member 51 may be pivoted about one side end. In this case, it is preferred that the tab be arranged on the other side end.

In the third embodiment, there may be more than one pivot 83, and the holding member 51 may be bent at multiple locations. More specifically, the holding member 51 may include the first piece 81, the second piece 82, and at least one further piece such as a third piece. The three or more pieces are connected in series by the pivots 83 and configured to take a straight formation in a closed state and a bent formation in the closed state. In the bent formation, the holding member 51 is bent in the direction in which the plug body 52 approaches the inlet 43. Preferably, the urging member 84 that urges the holding member 51 from the straight formation to the bent formation is arranged on at least one of the pivots 83. In this case, it is preferred that the formation holding mechanism 85 be used to hold the holding member 51 in the straight formation when the cover 32 is closed. The formation holding mechanism 85 includes a contact portion that contacts one of the two pieces located at opposite sides of the pivot where the urging member 84 is arranged to hold the holding member 51 in the straight formation.

In the fourth embodiment, the holding member 51 may be held to be slidable in the widthwise direction X. Further, the holding member 51 may be pulled to slide from the close position and open the inlet 43, and the holding member 51 may be pushed to slide from the open position and close the inlet 43.

The plug body 52 may be entirely fitted into the through hole 51*a* of the holding member 51. In this structure, if the inlet 43 opens at the distal end of the tube 42, the plug body 52 is fitted onto the tube 42 to seal the inlet 43.

The inlet 43 may be located in any surface of the liquid holder 40. For example, the inlet 43 may be located in the front surface of the liquid holder 40. In this case, the plug 50 may be pivotal about the lower end (second end) of the holding member 51 or be held to be slidable in the vertical direction (longitudinal direction) of the holding member 51.

The housing 33 only needs to be able to accommodate one or more of the liquid holders 40 in a predetermined direction. For example, the housing may have a small depth and cover only the lower portion (e.g., lower half) of the liquid holders 40. Alternatively, the housing may be a frame-shaped housing having front, rear, left, and right surfaces that are open. Further, the window 33*b* may be omitted from the housing 33.

In each of the above embodiments, the cover 32 may be omitted. Further, there may be only one liquid holder 40.

The liquid ejection device 12 does not have to form part of the all-in-one machine 11 and may be a printer dedicated to printing.

The liquid ejected from the liquid ejector 21 is not limited to ink and may be, for example, a liquid body formed by dispersing or mixing particles of a functional material. For example, the liquid may be a liquid body in which electrode material or color material (pixel material) is dispersed or dissolved. Such a material is used to manufacture a liquid crystal display, an electroluminescence (EL) display, or a planar light-emitting display. In this manner, the liquid ejection device may eject a liquid body in which material, such as an electrode material or a color material, used to manufacture the above types of displays is dispersed or dissolved. The liquid ejection device may also eject an ultraviolet curing resin liquid or a liquid including a functional material.

The medium M onto which the liquid ejection device ejects liquid is not limited to paper and may be a plastic film or sheet, a thin plate, metal foil, laminate film, a circuit board, or a cloth used in a cloth printing device. The medium M may also be clothing having any shape such as a T-shirt or a three-dimensional object having any shape such as dishware or stationery.

The liquid ejection device may be a three-dimensional liquid ejection device that molds a three-dimensional object by ejecting resin liquid using a liquid ejection technique (e.g., inkjet technique).

The present examples and embodiments are to be considered as illustrative and not restrictive, and the invention is not to be limited to the details given herein, but may be modified within the scope and equivalence of the appended claims.

The invention claimed is:

1. A liquid holding unit that supplies liquid to a liquid ejector of a liquid ejection device, the liquid holding unit comprising:

a liquid holder configured to hold the liquid;

a housing that accommodates the liquid holder;

an inlet used to fill the liquid holder with the liquid;

a plug configured to open and close the inlet, the plug including an elastically deformable plug body that covers the inlet and a holding member that holds the plug body and has higher rigidity than the plug body;

a shaft arranged on one of the housing and the plug, the plug being pivotal about the shaft;

an engagement portion arranged on the other one of the housing and the plug, the engagement portion being engaged with the shaft; and two supports that hold the shaft such that two axial sides of the engagement portion are held between the two supports in a state in which the engagement portion is engaged with the shaft.

2. The liquid holding unit according to claim 1, wherein the holding member includes a first end, a second end, and a side end that intersects the first end and the second end, and the holding member further includes a tab arranged on the first end, the tab being held to open and close the inlet.

3. The liquid holding unit according to claim 2, wherein the plug body is located between the tab and the second end on the holding member.

4. The liquid holding unit according to claim 1, wherein the liquid holder is one of a plurality of liquid holders, the plug is one of a plurality of plugs, and each of the plugs is arranged on a corresponding one of the liquid holders and includes the plug body for the corresponding one of the liquid holders.

5. The liquid holding unit according to claim 1, wherein the holding member is elongated in one direction and configured to hold the plug body so that the plug body is movable in a longitudinal direction of the holding member.

6. The liquid holding unit according to claim 1, further comprising a positioning guide including a projection and a recess, wherein the positioning guide is configured to guide and position the plug relative to the inlet by inserting the projection into the recess in a state in which the inlet is closed by the plug, the holding member includes one of the projection and the recess, and the liquid holder or the housing includes the other one of the projection and the recess.

7. The liquid holding unit according to claim 1, further comprising a cover that covers the plug, wherein the cover or the housing includes a restriction portion that contacts the holding member in a state in which the holding member is pivoted in a direction opening the inlet to restrict a pivot range of the holding member.

8. The liquid holding unit according to claim 1, further comprising a cover that covers the plug, wherein the cover includes a pushing portion that is configured to push the plug toward the inlet.

9. The liquid holding unit according to claim 1, wherein the holding member includes a through hole into which at least part of the plug body is fitted, an opening of the through hole at an opposite side of the plug body is covered by a covering, and the covering is in correspondence with a color of the liquid held in the liquid holder.

10. The liquid holding unit according to claim 1, wherein the holding member includes a first piece located toward a first end of the holding member and provided with the plug body, a second piece located toward a second end of the holding member, and a pivot located between the first piece and the second piece, in a state in which the plug is located at an open position, the holding member takes a bent formation in which the first piece is pivoted about the pivot relative to the second piece in a direction in which the plug body approaches the inlet, and in a state in which the plug is located at a close position, the holding member takes a straight formation in which the first piece and the second piece are arranged straight.

11. The liquid holding unit according to claim 10, wherein the holding member further includes an urging member that urges the holding member in a direction that bends the holding member from the straight formation to the bent formation.

12. The liquid holding unit according to claim 11, further comprising:

a cover configured to open and close so that the cover exposes the plug in an open state and covers the plug in a closed state; and a formation holding mechanism that contacts at least one of the first piece and the second piece when the cover is in the closed state to hold the holding member in the straight formation and keep the plug body at the close position.

13. A liquid injection device comprising:

the liquid holding unit according to claim 1, and a liquid ejector that ejects liquid supplied from the liquid holder of the liquid holding unit.

14. The liquid holding unit according to claim 1, further comprising an axial displacement restriction spacer that extends from at least one of the supports and the engagement portion in an axial direction of the shaft.

15. A liquid holding unit that supplies liquid to a liquid ejector of a liquid ejection device, the liquid holding unit comprising:

a liquid holder configured to hold the liquid;

a housing that accommodates the liquid holder;

an inlet used to fill the liquid holder with the liquid;

a plug configured to open and close the inlet, the plug including an elastically deformable plug body that covers the inlet and a holding member that holds the plug body and has higher rigidity than the plug body;

a shaft arranged on one of the housing and the plug, the plug being pivotal about the shaft;

an engagement portion arranged on the other one of the housing and the plug, the engagement portion being engaged with the shaft; and a cover that covers the plug from above, wherein the cover or the housing includes a restriction portion that contacts the holding member in a state in which the holding member is pivoted in a direction opening the inlet to restrict a pivot range of the holding member.

16. A liquid holding unit that supplies liquid to a liquid ejector of a liquid ejection device, the liquid holding unit comprising:

a liquid holder configured to hold the liquid;

a housing that accommodates the liquid holder;

an inlet used to fill the liquid holder with the liquid;

a plug configured to open and close the inlet, the plug including an elastically deformable plug body that covers the inlet and a holding member that holds the plug body and has higher rigidity than the plug body;

a shaft arranged on one of the housing and the plug, the plug being pivotal about the shaft;

an engagement portion arranged on the other one of the housing and the plug, the engagement portion being engaged with the shaft; and a cover that covers the plug from above, wherein the cover includes a pushing portion that is configured to push the plug toward the inlet.

* * * * *